US010164382B1

(12) United States Patent
Yen

(10) Patent No.: US 10,164,382 B1
(45) Date of Patent: Dec. 25, 2018

(54) ELECTRICAL PLUG HAVING A CONNECTION BLOCK AND METHODS OF ASSEMBLING THE SAME

(71) Applicant: Chun-Chang Yen, Hsinchu (TW)

(72) Inventor: Chun-Chang Yen, Hsinchu (TW)

( * ) Notice: Subject to any disclaimer, the term of this patent is extended or adjusted under 35 U.S.C. 154(b) by 0 days.

(21) Appl. No.: 15/950,008

(22) Filed: Apr. 10, 2018

Related U.S. Application Data

(60) Provisional application No. 62/632,629, filed on Feb. 20, 2018.

(51) Int. Cl.

| | |
|---|---|
| ***H01R 13/66*** | (2006.01) |
| ***H01R 13/688*** | (2011.01) |
| ***H01R 13/506*** | (2006.01) |
| ***H01R 13/424*** | (2006.01) |
| ***H01R 4/2407*** | (2018.01) |
| ***H01R 4/18*** | (2006.01) |
| *H01R 13/68* | (2011.01) |

(52) U.S. Cl.
CPC ..... *H01R 13/688* (2013.01); *H01R 4/183* (2013.01); *H01R 4/2407* (2018.01); *H01R 13/424* (2013.01); *H01R 13/506* (2013.01); *H01R 13/68* (2013.01)

(58) Field of Classification Search
CPC ..... H01R 13/68
USPC ..... 439/620.3
See application file for complete search history.

(56) References Cited

U.S. PATENT DOCUMENTS

| | | | | |
|---|---|---|---|---|
| 4,902,250 | A * | 2/1990 | Wu | H01R 13/68 337/197 |
| 4,904,976 | A * | 2/1990 | Liaq | H01R 13/68 337/197 |
| 6,547,600 | B2 | 4/2003 | Yen | |
| 6,692,291 | B2 * | 2/2004 | Chen | H01R 4/2433 439/417 |
| 7,048,557 | B2 | 5/2006 | Yen | |

FOREIGN PATENT DOCUMENTS

| | | |
|---|---|---|
| CN | 2063700 U | 10/1990 |
| TW | 127058 | 1/1990 |

* cited by examiner

*Primary Examiner* — Tho D Ta
(74) *Attorney, Agent, or Firm* — Seed IP Law Group LLP

(57) ABSTRACT

An electrical plug including an outer housing with an interior cavity defined by first and second apertures is disclosed. The outer housing includes a third aperture extending into the interior cavity. An inner housing is coupleable to the interior cavity and includes a pair of first terminals electrically coupled to a pair of fuses. A connection block is coupleable to the outer housing and the inner housing, with the connection block including a pair of second terminals electrically coupled to a pair of wires. The connection block is coupled to the outer housing and the inner housing through the third aperture with the pair of second terminals electrically coupled with the pair of fuses. In one embodiment, the connection between the pair of second terminals and the pair of wires includes crimping, while in other embodiments, the connection includes piercing a non-conductive layer surrounding each of the wires.

26 Claims, 20 Drawing Sheets

ELECTRICAL PLUG HAVING A CONNECTION BLOCK AND METHODS OF ASSEMBLING THE SAME

BACKGROUND

Technical Field

The present disclosure generally relates to an electrical plug and, more particularly, to an electrical plug for use in light sets having a connection block for creating an electrical connection between wires coupled to the block and fuses within the plug.

Description of the Related Art

It is well known that electrical plugs are used to connect strings of lights to exterior circuits or power supplies. While certain aspects of the construction of such plugs have been automated to improve manufacturing efficiency, existing electrical plugs still suffer from inefficiencies during construction.

For example, a typical electrical plug includes an inner body coupled inside of an exterior housing. The inner body has two channels, with a terminal mounted in each channel. A protective layer of a wire is removed, and the strands of wire are coupled to each terminal, either with solder, glue, or other coupling devices. Because of the small space in the channel and the intricate detail required, construction of these features of an existing plug is typically performed manually, as the processes may not be suitable for automation. This results in an increase in labor cost, which results in a higher product price, and also lower efficiencies in terms of time and manufacturing capacity. Further, such plugs often suffer from failure at this connection, as the electrical plug will no longer operate if any of these components become out of place, either through repeated use or during construction.

As such, there remains a need for an electrical plug that increases automation of the construction process by reducing features requiring manual assembly, while also increasing the reliability of the plug by improving the strength of the connection between the wires and the terminals.

BRIEF SUMMARY

The exemplary embodiments of the present disclosure are directed to improving the reliability of electrical plugs by providing a stronger, more secure connection between terminals and fuses in the plug while also increasing manufacturing efficiency by providing easy-to-assemble components that are suitable for automation.

In one exemplary embodiment, an electrical plug includes an outer housing having an interior cavity extending between a first aperture in a first portion of the outer housing and a second aperture in a second portion of the outer housing. The outer housing further includes a third aperture in a third portion of the outer housing, wherein the third portion is positioned between the first and second portions and the third aperture extends through the outer housing to the interior cavity. An inner housing is coupleable to the outer housing within at least a portion of the interior cavity, the inner housing extending from the first aperture to the second aperture when the inner housing is in an operating position within the outer housing. A pair of fuses are removably coupled to the inner housing. A pair of terminal blades are coupled to the inner housing such that the terminal blades project beyond the second portion of the outer housing when the inner housing is in the operating position. Further, each of the pair of terminal blades are electrically coupled to a corresponding one of the pair of fuses.

A connection block is insertable into the third aperture and coupleable to the outer housing and the inner housing. The connection block includes a pair of wires and a pair of terminals, wherein each wire of the pair of wires is electrically coupled to a corresponding one of the terminals and each terminal of the pair of terminals is electrically coupled to a corresponding one of the pair of fuses when the connection block is in an engaged position within the outer housing and inner housing. When the connection block is in the engaged position, the inner housing is in the operating position.

In certain aspects, the electrical coupling between each of the pair of terminals and each of the pair of wires includes crimping each of the terminals to each of the wires, while in other aspects, the electrical coupling includes each of the pair of terminals piercing a non-conductive layer covering a corresponding one of each of the pair of wires. In embodiments where the electrical coupling includes piercing, each of the pair of terminals includes at least one serrated edge with the at least one serrated edge piercing the non-conductive layer covering each of the pair of wires.

In order to connect the wires to the connection block, the connection block further includes a pair of guides with each guide having an entrance portion with a first area and an exit portion with a second area, the first area being less than, or smaller than, the second area. A groove is proximate each exit portion with the groove having a size and a shape to receive a corresponding one of the pair of wires and hold, in combination with the outer housing, the corresponding one of the pair of wires in a bent configuration. In another alternative embodiment, the inner housing further includes a pair of opposing ridges and the connection block includes a pair of opposing flanges. The coupling between the connection block and the inner housing includes each of the pair of opposing flanges securely physically engaging a corresponding one of the pair of opposing ridges of the inner housing when the connection block is in the engaged position.

In another alternative exemplary embodiment, the outer housing includes a fourth aperture extending through the outer housing to the interior cavity and a fuse cover coupled to the outer housing. The fuse cover is moveable between an open position and a closed position. In the open position, the pair of fuses are exposed through the fourth aperture, and in the closed position, the fuse cover overlies the fourth aperture and the pair of fuses. The electrical plug of this embodiment can also include each of the pair of fuses further having a first end cap opposite a second end cap. The first end cap is electrically coupled to a corresponding one of the pair of terminal blades and the second end cap is electrically coupled to a corresponding one of the pair of terminals. Further, the outer housing includes a first locking member and the inner housing further includes a second locking member with the first locking member securely physically engaging the second locking member when the inner housing is in the operating position.

In a second exemplary embodiment, an electrical plug includes a body having an aperture in a wall of the body. The body includes a pair of first terminals coupled to the body and a pair of fuses positioned within the body with each of the pair of first terminals electrically coupled to a corresponding one of the pair of fuses. The plug also includes a connection block coupled to the body through the aperture in the wall of the body when the connection block is an operating position.

The connection block includes a housing having a first surface and a pair of guides formed in the housing. Each guide has an entrance portion in the first surface of the housing and an exit portion opposite the entrance portion. A pair of wires are coupled to the housing, with each of the pair of wires positioned in a corresponding one of the pair of guides. The connection block further includes a pair of second terminals with each of the second terminals positioned proximate the entrance portion of a corresponding one of the pair of guides and electrically coupled to a corresponding one of the pair of wires and a corresponding one of the pair of fuses when the connection block is in the operating position. Finally, a pair of protrusions project from the first surface of the body of the connection block with each of the second terminals being in contact with a corresponding one of the pair of protrusions.

In certain other aspects of this embodiment, the electrical plug includes the pair of guides having an area of the entrance portion of each guide of the pair of guides being less than an area of the exit portion of each guide of the pair of guides. In other aspects of this embodiment, a fuse clip is electrically coupled to one of the pair of second terminals and a corresponding one of the pair of fuses and the body includes an inner housing positioned in the body and coupled to the body, the inner housing including a fuse clip aperture with an arm of the fuse clip inserted through the fuse clip aperture. Further, the housing of the connection block can include a channel formed in the housing between each of the pair of guides. The body includes a bar proximate the aperture in the wall of the body with the channel of the housing of the connection block having a size and a shape to receive the bar of the body when the connection block is in the operating position.

A third exemplary embodiment includes an electrical plug having a body with an aperture extending into the body. The body includes a pair of first terminals coupled to the body and a pair of fuses coupled to the body with each of the pair of first terminals electrically coupled to a corresponding one of the pair of fuses. The electrical plug further includes a connection block, with the connection block extending through the aperture in the body and being coupled to the body when the connection block is in an operating position.

The connection block includes a housing having a first surface adjacent a second surface and a pair of tunnels formed in the housing with each tunnel including a first opening in the second surface of the housing and a second opening. Each of a pair of wires is positioned within the second opening of a corresponding one of the pair of tunnels. The connection block further includes a pair of second terminals with each of the second terminals positioned proximate the first opening of a corresponding one of the pair of tunnels and electrically coupled to a corresponding one of the pair of wires and a corresponding one of the pair of fuses when the connection block is in the operating position. A pair of protrusions project from the first surface of the housing with each of the second terminals being in contact with a corresponding one of the pair of protrusions.

In an aspect of this third embodiment, the first opening of each tunnel of the pair of tunnels includes a slot extending along a length of the second surface. Further, each of the pair of second terminals includes a plurality of first teeth and a plurality of second teeth with the plurality of second teeth including a flange. The electrical coupling between the pair of second terminals and the pair of wires includes piercing a non-conductive layer covering each of the pair of wires with the first and second plurality of teeth of each of the pair of second terminals wherein the flange of the plurality of second teeth securely physically engages the non-conductive layer covering each of the pair of wires. Further, each of the pair of second terminals includes a terminal and a connection member with a thickness of the terminal being greater than a height of the connection member. Finally, the second surface of the connection block can include a pair of opposing inserts with each of the pair of opposing inserts connected to a corresponding one of the first openings of the pair of tunnels and having a size and a shape to receive a portion of the terminal and a portion of the connection member of each of the pair of second terminals.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with leadframes and chip packaging have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to." Further, the terms "first," "second," and similar indicators of sequence are to be construed as interchangeable unless the context clearly dictates otherwise.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The present disclosure is generally directed to electrical plugs having a connection block that is coupleable to an outer housing and an inner housing of the plug, wherein each plug includes easy to assembly components that provide for a strong connection between terminals of the connection block and fuses coupled to the inner housing.

Figure 1A:
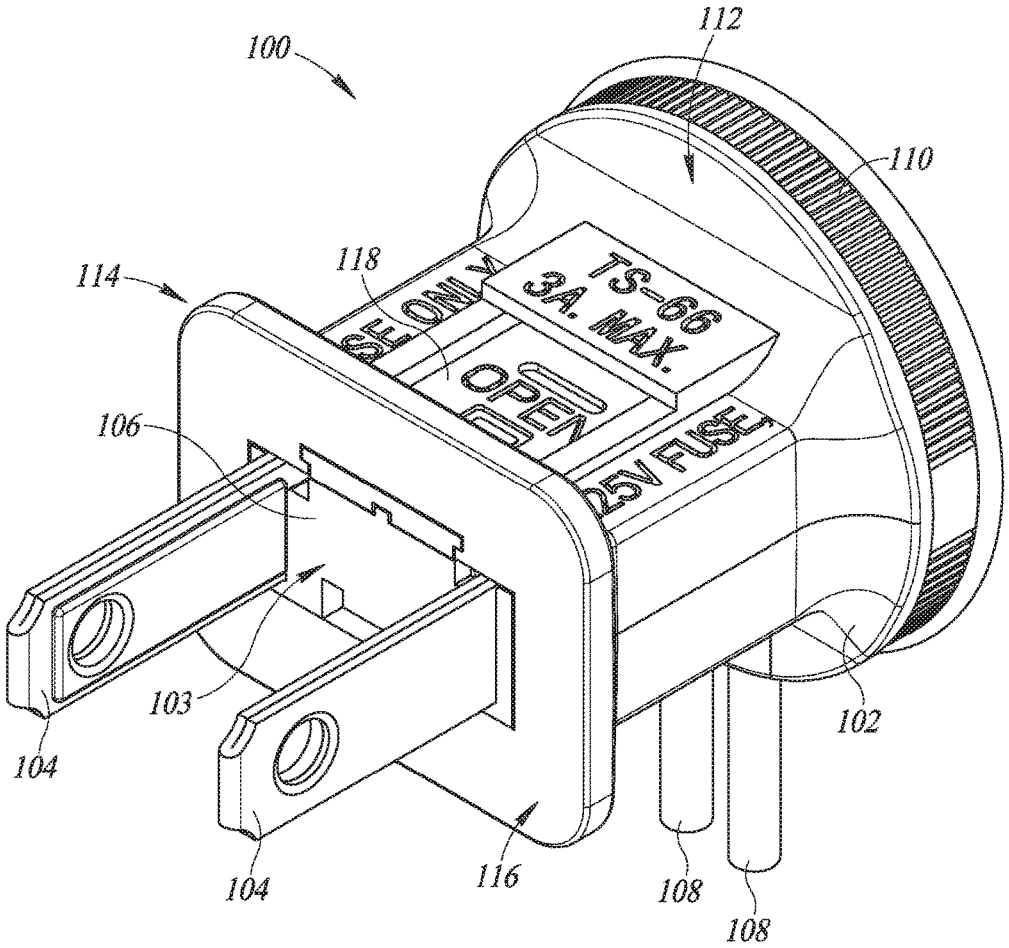
FIG. 1A is a perspective view of an exemplary embodiment of an electrical plug according to the present disclosure having a connection block coupled to the plug.

FIG. 1A is a perspective view of an exemplary embodiment of an electrical plug 100 illustrated in a fully constructed and operational configuration. The electrical plug 100 includes an outer housing 102 coupled to an inner housing 106. The outer housing 102 includes a first portion 112 and a second portion 114. In the illustrated embodiment, the first portion 112 is a rear portion and the second portion 114 is a forward, or front, portion. A pair of terminal blades, or pair of first terminals 104, are coupled to the inner housing 106 and positioned such that the pair of terminal blades 104 project beyond the second portion 114 of the outer housing 102 when the electrical plug 100 is in the operating position, as illustrated. In other words, the terminal blades 104 extend from a first surface 116 of the second portion 114 of the outer housing 102.

The electrical plug 100 further includes a fuse cover 118, which will be described in more detail below. In an embodiment, the electrical plug 100 also includes a plurality of channels 110 arranged proximate the first portion 112 in order to allow a user to more easily grip the electrical plug 100 during use. The inner housing 106 has a first surface 103, which in the operational position in the embodiment illustrated in FIG. 1A, is substantially coplanar with the first surface 116 of the second portion 114 of the outer housing. The inner housing further includes a base plate 101 (FIG. 3A) that is proximate the first portion 112 of the outer housing 102. As such, the inner housing 106 extends from the first aperture 126 (FIG. 2A) to the second aperture 130 (FIG. 2A) of the outer housing 102 when the inner housing 106 is in the operating position within the outer housing 102, as illustrated in FIG. 1A.

The outer housing 102 and the inner housing 106 preferably comprise plastic or another electric insulator, although one of skill in the art will appreciate that other non-conductive materials may be used. Exemplary methods of forming such plastic components include blow molding, rotational molding, injection molding, compression molding, gas assist molding, or thermoforming, among others.

In operation, a user electrically couples the pair of terminal blades 104 to an exterior circuit or power supply, such as a common household outlet connected to the interior circuitry of a house. Electrical current from the internal circuitry of the house travels through the terminal blades 104, through the electrical plug 100, as described below, and then to a pair of wires 108 coupled to the electrical plug 100. The wires 108 transmit power to lights (not shown), or other electrical devices arranged electrically downstream from the electrical plug 100.

Figure 1B:
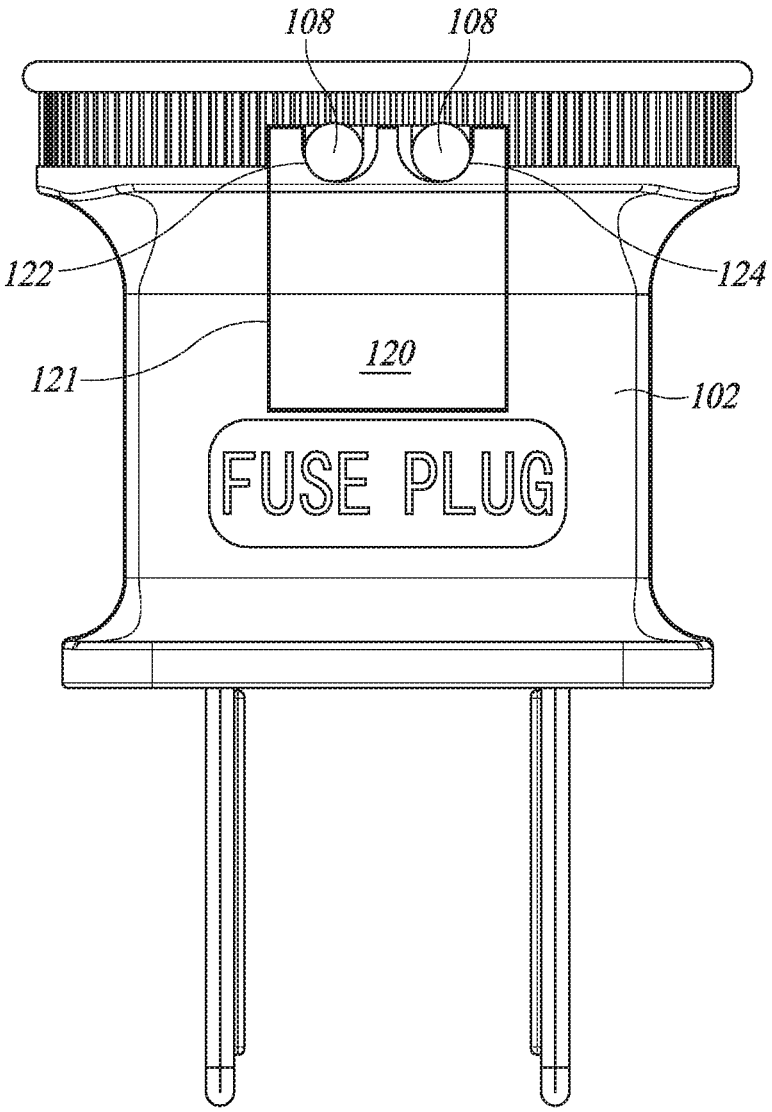
FIG. 1B is a bottom plan view of the electrical plug of FIG. 1A.

FIG. 1B illustrates a connection block 120 coupled to the outer housing 102. The connection block 120 includes the pair of wires 108 coupled to the connection block 120. The wires 108 are held securely in place between the outer housing 102 and the connection block 120 by a first groove 122 and a second groove 124, with each groove 122, 124 corresponding to one of the pair of wires 108. Preferably, each of the wires 108 is in contact with the outer housing 102 and the grooves 122, 124 in order to limit the range of motion of the wires, thus reducing the possibility of stress on the interior components of the electrical plug 100 described below. Further, in an embodiment, the grooves 122, 124, in combination with the outer housing 102, hold the wires 108 in a bent configuration, which further prevents the wires 108 from pulling out of contact with internal electrical components of the electrical plug 100 when a force is exerted on the wires 108.

Figure 2A:
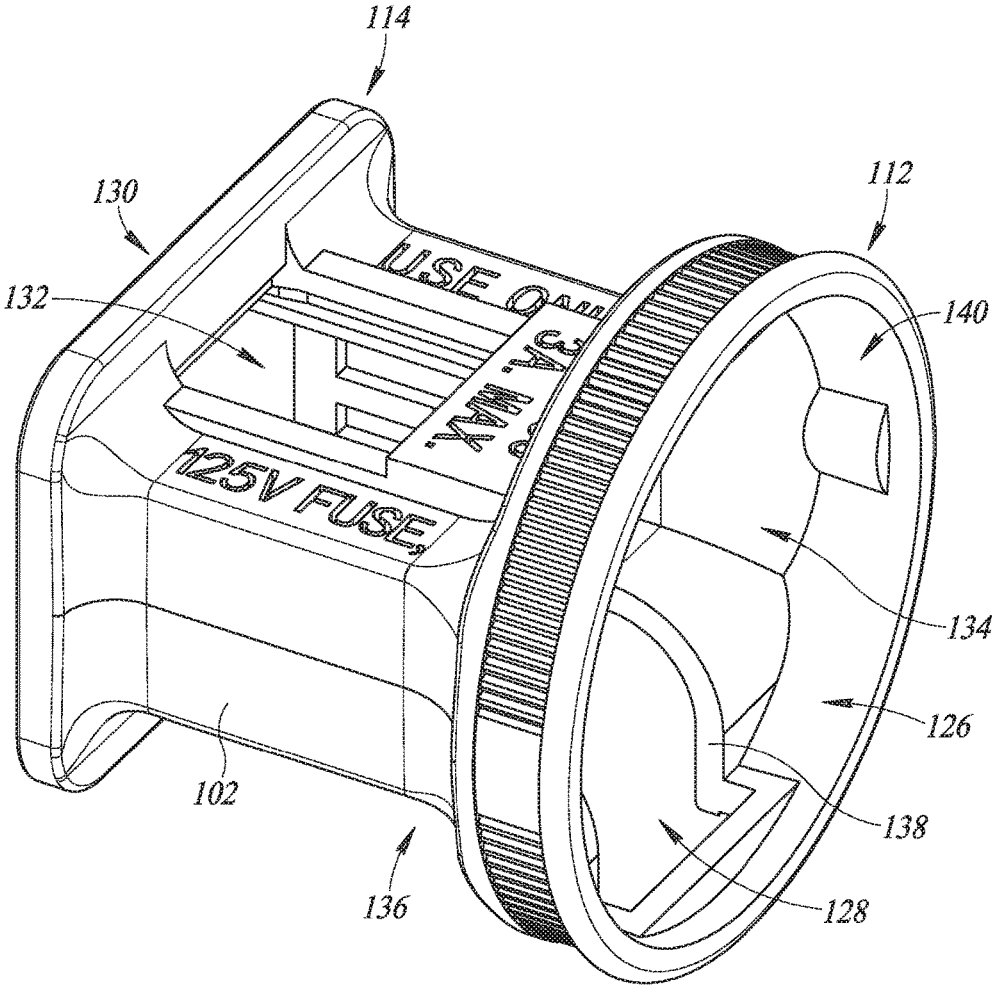
FIG. 2A is a perspective view of an outer housing of the plug of FIG. 1A having an interior cavity extending between a first and second aperture and a third aperture positioned between the first and second apertures.

FIG. 2A illustrates the outer housing 102 of the electrical plug 100 (FIG. 1A) in additional detail. The outer housing 102 includes the first portion 112 spaced from, and opposite to, the second portion 114 and having an interior surface 140. The first portion 112 includes a first aperture 126 and the second portion 114 includes a second aperture 130. An interior cavity 134 extends through the outer housing 102 between the first aperture 126 and the second aperture 130.

In other words, the outer housing 102 is preferably hollow, with first and second apertures 126, 130 opposite each other on either end of the outer housing 102. In an embodiment, the outer housing 102 includes a fourth aperture 132 for selectively allowing access to fuses 236 (FIG. 4E) within the outer housing 102 via the fuse cover 118 (FIG. 1A), as explained below.

The outer housing 102 further includes a third portion 136 positioned in between the first portion 112 and the second portion 114. The third portion 136 includes a third aperture 128 extending through the outer housing 102 and into the interior cavity 134. The third aperture 128 has a size and a shape to receive the connection block 120 (FIG. 1B). Preferably, the third aperture 128 has a size and shape to receive the connection block 120 (FIG. 1B) in a friction fit. Alternatively, the third aperture 128 preferably has a size and shape to provide a gap between an outer edge 121 (FIG. 1B) of the connection block 120 (FIG. 1B) and an outer edge 138 of the third aperture 128 of less than 5 millimeters ("mm"), more preferably less than 3 mm, more preferably less than 2 mm, and more preferably less than 1 mm.

Figure 2B:
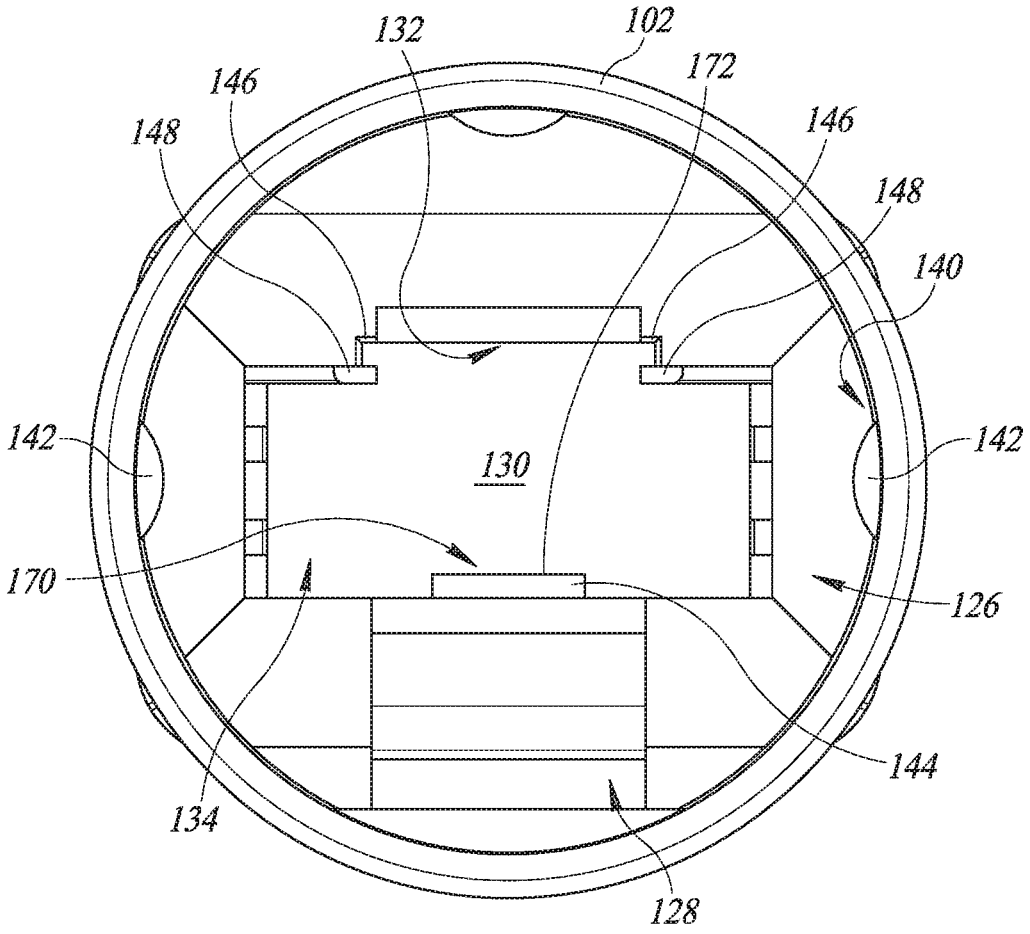
FIG. 2B is a rear elevational view of the outer housing of FIG. 2A.
Figure 3A:
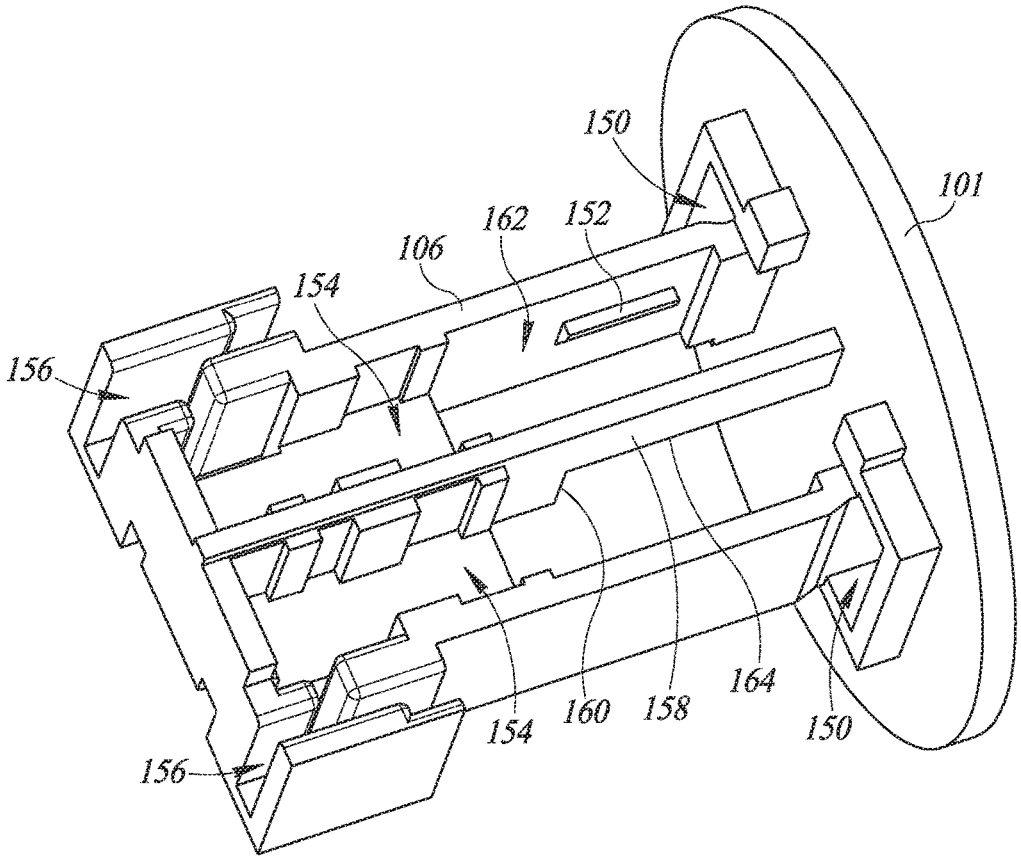
FIG. 3A is a perspective view of an inner housing of the plug of FIG. 1A.

FIG. 2B illustrates the first aperture 126 and the second aperture 130 of the outer housing 102 in more detail. The illustrated first aperture 126 has a generally circular shape with a size and a shape to receive the base plate 101 (FIG. 3A) of the inner housing 106 (FIG. 3A). Preferably, the first aperture 126 receives the base plate 101 (FIG. 3A) in a friction fit, although a gap may be provided between an outer edge of the base plate 101 and an outer edge of the first aperture 126 of less than 5 mm, more preferably less than 3 mm, and more preferably less than 1 mm. Further, support members 142 are positioned on an interior surface 140 of the outer housing 102 proximate the second aperture 130 to prevent the base plate 101 (FIG. 3A) and inner housing 106 (FIG. 3A) from sliding through the interior cavity 134. In other words, in the operating position, as shown in FIG. 1A, a surface of the base plate 101 is proximate to, or in contact with, each of the support members 142 such that the support members 142 limit lateral translation of the inner housing 106 (FIG. 1A) relative to the outer housing 102 in at least one direction of motion, or in at least a first direction of motion.

The outer housing 102 further includes a first locking member 144, which cooperates with a second locking member 166 (FIG. 3B) on the inner housing 106 (FIG. 3B) to prevent the inner housing 106 (FIG. 3B) from uncoupling from the outer housing 102 once assembled. The first and second locking members 144, 166 further increase safety of the electrical plug 100 (FIG. 1A), as the inner housing 106 (FIG. 3B), which contains electrically active components when connected to an exterior power supply, cannot exit the outer housing 102 after the coupling.

In an embodiment, the outer housing 102 includes opposing fuse cover channels 146 proximate the fourth aperture 132. Each fuse cover channel 146 is further defined by a channel guide 148 that defines an outer boundary of each channel 146. The channels 146 have a size and a shape to receive the fuse cover 118 (FIG. 1A) for selectively allowing access to the fourth aperture 132. In other words, the fuse cover 118 (FIG. 1A) is moveable between an open position and a closed position, wherein in the open position, the fuse cover 118 (FIG. 1A) is translated along the fuse cover channels 146 to allow access to the fourth aperture 132, thereby exposing fuses 236 (FIG. 4E) that are positioned beneath the fourth aperture 132 when the electrical plug 100 is in the fully constructed, operating position. In the closed position, as illustrated in FIG. 1A, the fuse cover 118 (FIG. 1A) overlies the fourth aperture 132, thereby preventing access to the fuses located proximate the fourth aperture 132. A moveable fuse cover 118 (FIG. 1A) as described herein reduces the risk of electrical shock, while also preventing water or other contaminants from entering the inner cavity 134 and shorting the electrical plug 100 (FIG. 1A).

FIG. 3A is a perspective view of the inner housing 106. As noted above, the inner housing 106 is received by the outer housing 102 (FIG. 2A). In other words, the inner housing 106 is coupleable to the outer housing 102 (FIG. 2A) within at least a portion of the interior cavity 134 (FIG. 2A). The inner housing 106 includes the base plate 101 positioned in the first aperture 126 (FIG. 2A) when the electrical plug 100 (FIG. 1A) is in the fully constructed, operating position, as in FIG. 1A. Opposing openings 150 in the base plate 101 have a size and a shape for receiving a pair of second terminal blades (not shown) in order to connect together multiple strings of lights, each having an electrical plug 100. The inner housing 106 further includes a pair of fuse channels 154 and a pair of terminal channels 156.

To secure the connection block 120 (FIG. 1B) to the inner housing 106, the inner housing includes a pair of opposing ridges 152 extending or projecting from an inner surface 162 of the inner housing 106. Further, the inner housing 106 includes a bar 158 between the opposing ridges 152. The bar includes a first edge 160 and a second edge 164. In an embodiment, the first edge 160 and the second edge 164 are substantially perpendicular. In other embodiments, the first edge 160 and the second edge 164 can form any transverse angle. In yet further embodiments, the first edge 160 and the second edge 164 are parallel, such that the bar 158 contains a single, unitary, integral outermost edge.

Figure 3B:
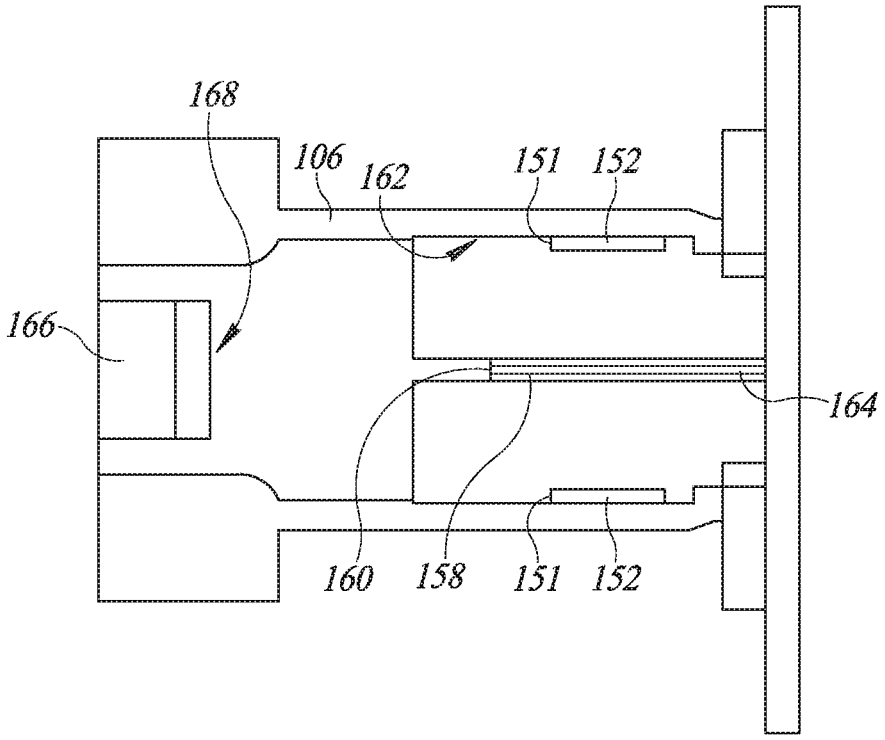
FIG. 3B is a bottom plan view of the inner housing of FIG. 3A.

FIG. 3B illustrates the opposing ridges 152 of the inner housing 106 in additional detail. In an embodiment, the opposing ridges 152 each contain an outer edge 151, wherein the outer edges 151 of the opposing ridges 152 are aligned. In other embodiments, one of skill in the art will appreciate that the outer edges 151 of the opposing ridges 152 can be spaced from each other. While it is preferable that the opposing ridges 152 are positioned on the inner surface 162 such that the opposing ridges 152 coordinate with the edges 160, 164 of the bar 158, embodiments of the present disclosure include the opposing ridges 152 positioned anywhere on the inner surface 162. As such, the present disclosure is not limited by the positioning and arrangement of the opposing ridges 152.

The inner housing 106 further includes the second locking member 166. When the inner housing 106 is inserted into the outer housing 102 (FIG. 1A) to position the electrical plug 100 (FIG. 1A) in the operating position, the first locking member 144 (FIG. 2B) securely physically engages the second locking member 166, such that translation of the inner housing 106 away from the outer housing 102 (FIG. 1A) is prevented. In other words, when the inner housing 106 is inserted into the outer housing 102, a securing surface 168 of the second locking member 166 translates beyond an outer edge 172 (FIG. 2B) of the first locking member 144, such that the securing surface 168 of the second locking member 166 engages a surface 170 (FIG. 2B) of the first locking member 144 to prevent lateral translation of the inner housing 106 relative to the outer housing 102 in at least one direction of motion opposite the first direction of motion prevented by the support members 142 and the base plate 101.

Figure 4A:
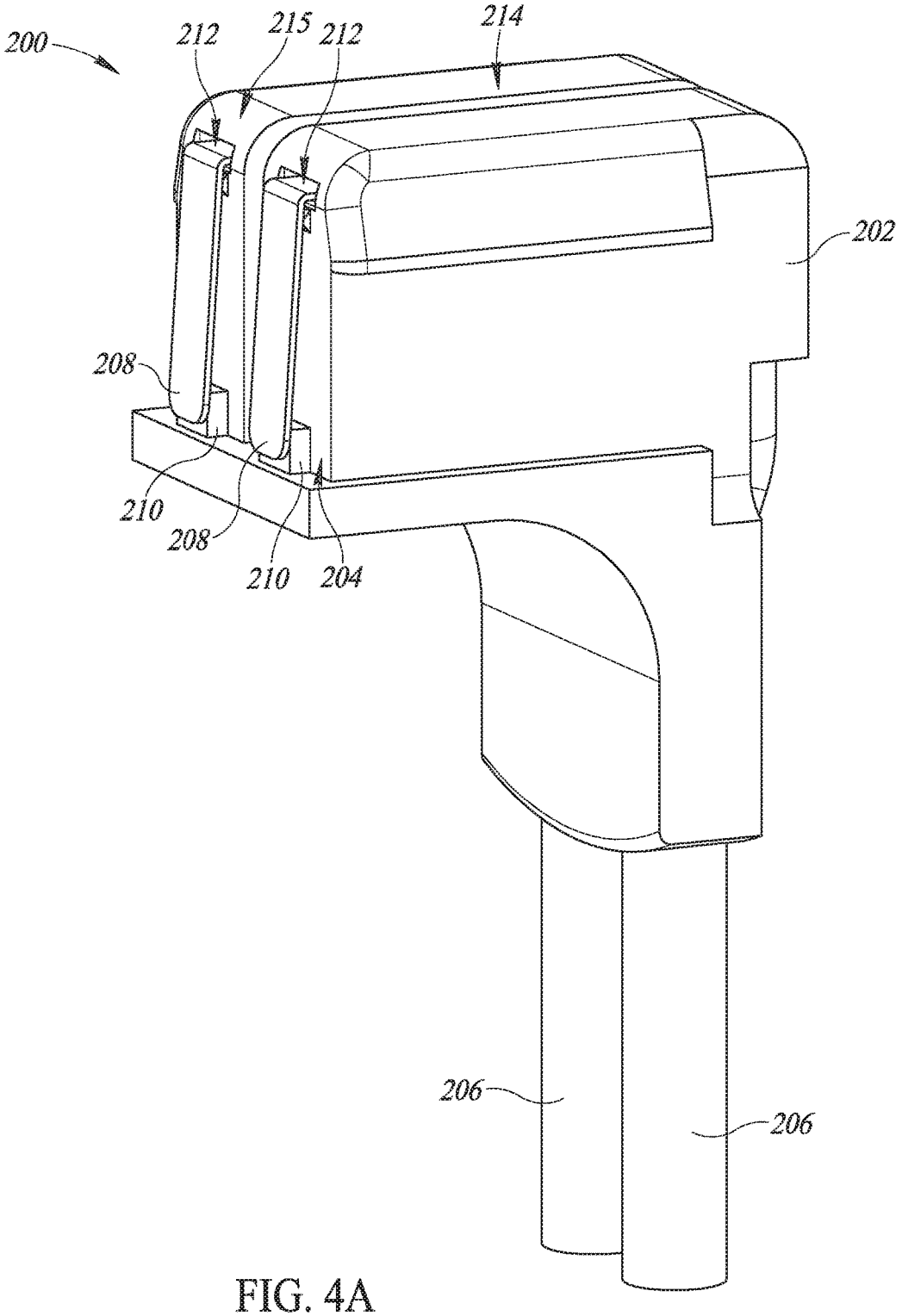
FIG. 4A is a perspective view of an exemplary embodiment of a connection block according to the present disclosure having terminals extending through an opening in a first surface of the connection block.
Figure 4B:
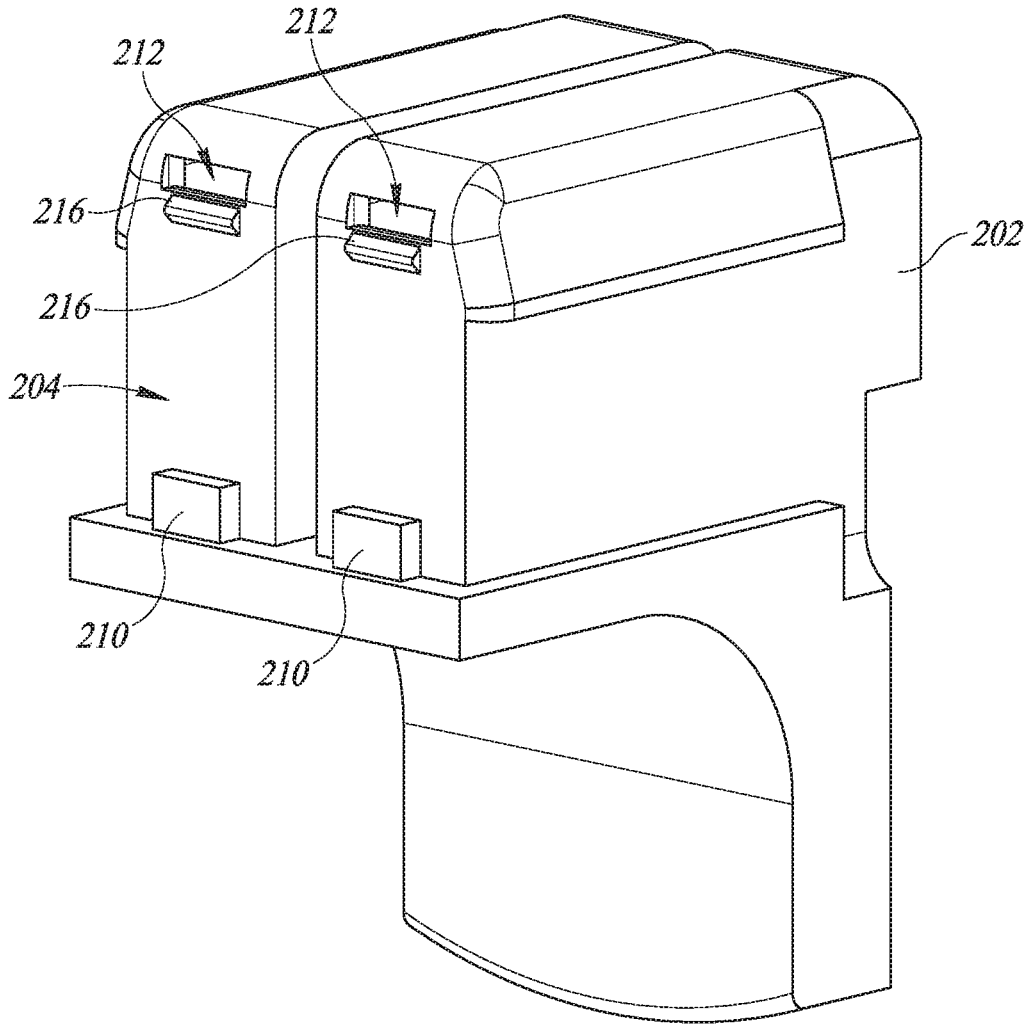
FIG. 4B is a perspective view of a housing of the connection block of FIG. 4A.

FIG. 4A illustrates one exemplary embodiment of a connection block 200 according to the present disclosure illustrated in an assembled configuration. The connection block includes a housing 202 having a first surface 204 and a second surface 214. In an embodiment, the first surface 204 and the second surface 214 are substantially flat and planar and are connected by at least one curved surface 215. A pair of wires 206 are coupled to the housing 202 and a pair of second terminals 208 are coupled to the pair of wires 206, with each second terminal 208 electrically coupled to a corresponding one of the pair of wires 206. Each of the pair of second terminals 208 are positioned proximate an entrance portion 212 of a guide 218 (FIG. 4B). A pair of protrusions 210 project from the first surface 204 of the housing 202, with each of the second terminals 208 positioned proximate a corresponding one of the pair of protrusions 210. Preferably, at least a portion of each of the pair of second terminals 208 are in contact with at least a portion of a corresponding one of the pair of protrusions 210.

Figure 4C:
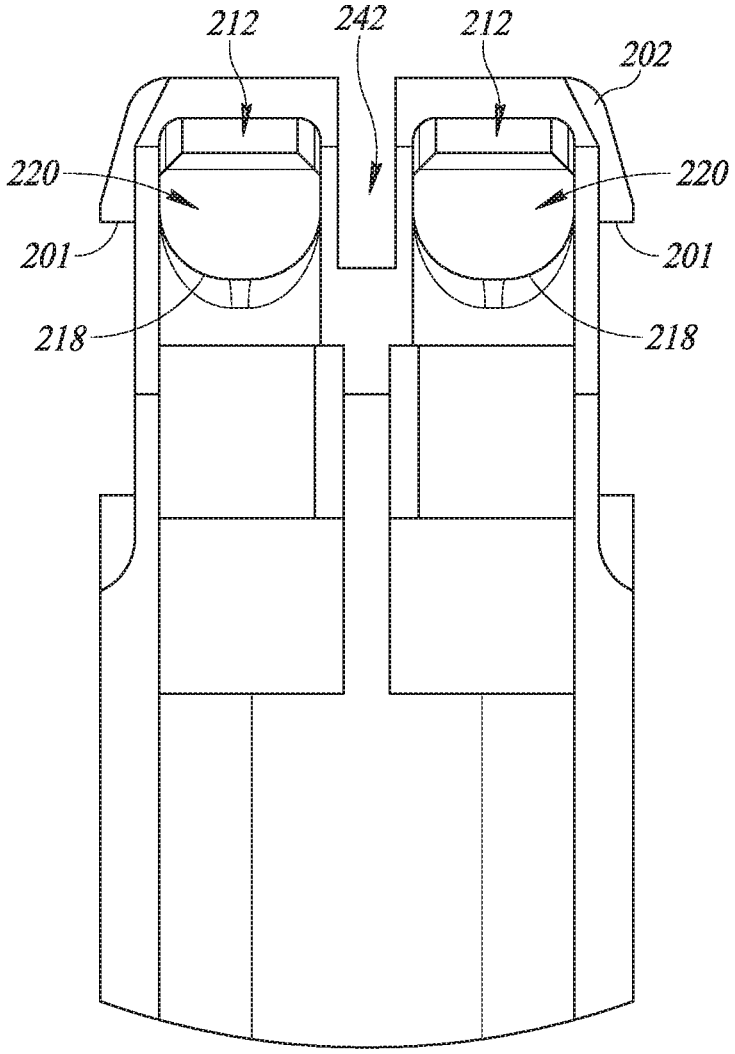
FIG. 4C is a rear elevational view of the housing of the connection block of FIG. 4A.

FIGS. 4B-4C illustrate the housing 202 of the connection block 200 in additional detail. The housing 202 includes the pair of protrusions 210 projecting, or extending, from the first surface 204 of the housing 202. In this embodiment, the pair of protrusions 210 are generally in the shape of a rectangular prism, although in other embodiments, the pair of protrusions may be formed from any number of possible shapes, for example, a hemisphere, a triangular prism, a trapezoidal prism, a cube, or a post, among others. Further, the pair of protrusions 210 may have a shape, in an embodiment, similar to a shape of a pair of second protrusions 216 projecting from the first surface 204. The pair of second protrusions 216 are generally in the shape of a trapezoidal prism, or a truncated triangular prism, but may have any of the above shapes noted with reference with to the pair of first protrusions 210. Further, in an embodiment, because the pair of first protrusions 210 and pair of second protrusions 216 extend from the first surface 204, the protrusions 210, 216 hold the pair of second terminals 208 (FIG. 4A) in a position that is spaced from the first surface 204 in order to ensure that a secure electrical coupling, or secure electrical contact is formed between each of the pair of second terminals 208 (FIG. 4A) and a second end cap 240 (FIG. 4E) of each of a corresponding one of a pair of fuses 236 (FIG. 4E).

The housing 202 further includes a pair of guides 218 formed in, and extending into the housing 202. Each guide 218 includes an entrance portion 212 in the first surface 204 of the housing and an exit portion 220 opposite the entrance portion 212. The entrance portion 212 includes a first area and the exit portion 220 includes a second area, wherein in this embodiment, the first area is less than the second area. In other embodiments, the first and second areas may be equal, while in yet further embodiments, the first area is greater than the second area. As shown in FIG. 4A, each of the wires 206 is positioned in a corresponding one of the pair of guides 218, with each of the pair of second terminals 208 positioned proximate to, or extending through, the entrance portion 212 of each guide 218.

In the illustrated embodiment, the housing 202 further includes a channel 242 formed in the housing 202 between each of the guides 218, wherein the channel 242 has a size and a shape to receive the bar 158 (FIG. 3B) of the inner housing 106 (FIG. 3B). The bar 158 (FIG. 3B) is preferably located proximate the third aperture 128 (FIG. 2A), and more preferably forms an upper boundary of the third aperture 128 (FIG. 2A), such that when the connection block 200 is inserted through the third aperture 128 (FIG. 2A), such as in the engaged, operating position shown in FIG. 1A, the channel 242 receives the bar 158 (FIG. 3B) and assists in securing the connection block 200 to the inner housing 106 (FIG. 3B). To further secure the connection block 200 to the inner housing 106 (FIG. 3B) and outer housing 102 (FIG. 1A), the housing 202 includes a pair of opposing flanges 201, wherein each flange of the pair of opposing flanges 201 physically securely engages a corresponding one of the pair of opposing ridges 152 (FIG. 3B) when the connection block 200 is in an engaged position, such as in FIG. 1A.

Figure 4D:
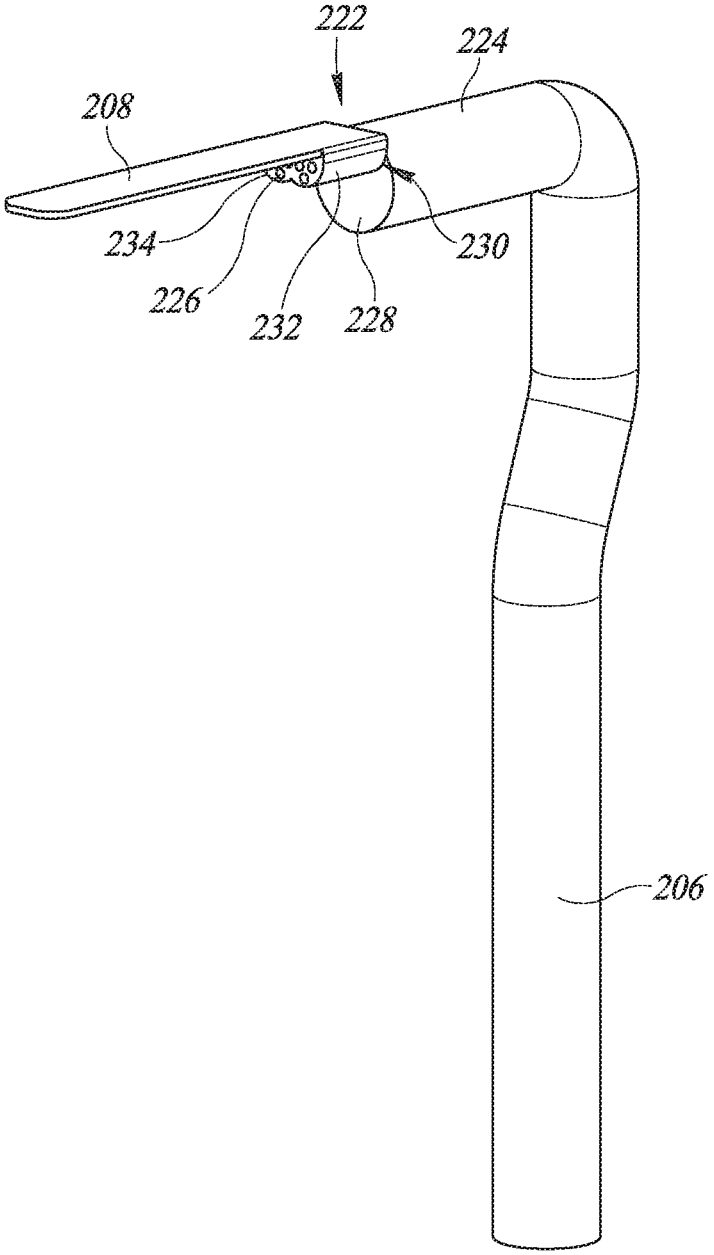
FIG. 4D is a perspective view of a wire adapted to be coupled to a terminal of the connection block of FIG. 4A.
Figure 4E:
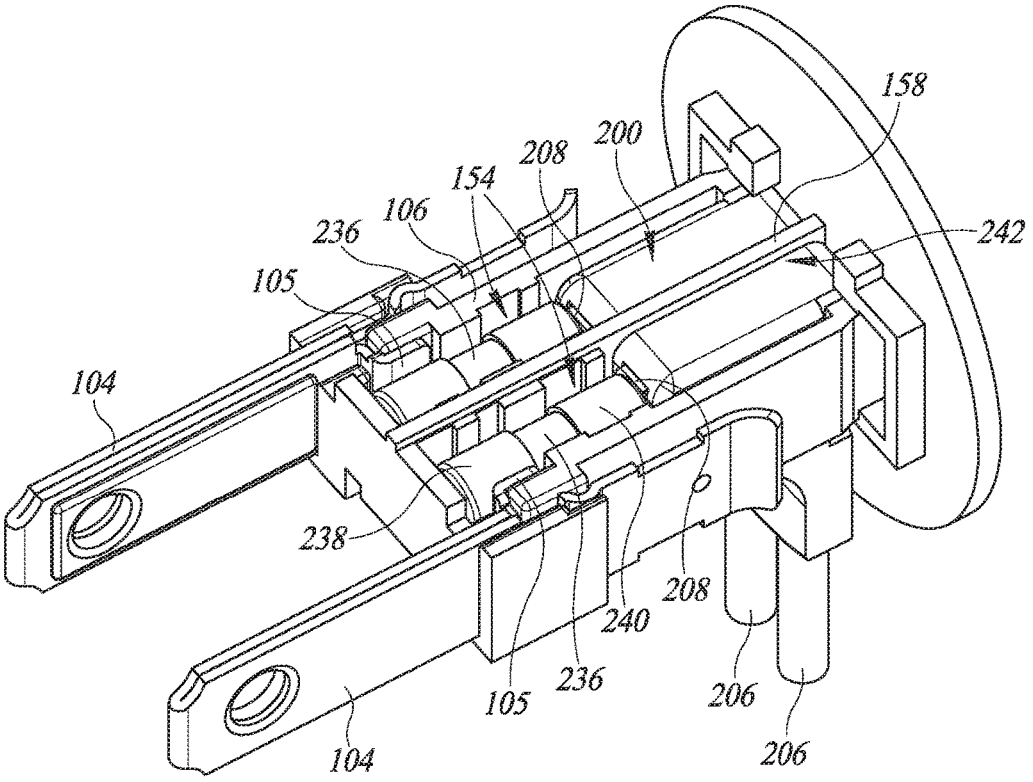
FIG. 4E is a perspective view of the connection block of FIG. 4A coupled to an inner housing.

FIG. 4D illustrates one of the wires 206 of the pair of wires 206 in more detail. As illustrated, each of the wires 206 is coupled to a corresponding one of the pair of second terminals 208. The pair of second terminals 208 are illustrated in an unbent configuration for insertion through the entrance portion 212 (FIG. 4C) of each guide 218 (FIG. 4C). The connection between the second terminal 208 and the wire 206 occurs at a coupling point 222. At the coupling point 222, a portion of the protective layer 224 covering each of the wires 206 is removed at an end 228 of each wire 206. Removing the protective layer 224 includes exposing strands of wire 226. One of skill in the art will further appreciate that the protective layer 224 may be any of a number of commercially available electrically insulating materials that are designed to protect the strands of wire 226 from water or other contaminants while also protecting the user. Further, the strands of wire 226 may include copper, or other electrical conductors. Finally, the pair of second terminals 208 may include copper, tin, nickel, gold, silver, or alloys of any of the same, among other electrical conductors.

A crimping portion 230 of each second terminal 208 is then bent, or crimped, around each of the strands of wire 226 to form a secure electrical connection between each second terminal 208 and each wire 206. In other words, because each of the second terminal 208, which includes the crimping portion 230 and the strands of wire 226 are formed of electrical conductors, when the terminal 208 is crimped to the strands of wire 226, an electrical connection is formed that can transmit electricity from the terminal 208 to each wire 206, and other electrical devices further electrically downstream, and coupled to, each wire 206. Preferably, the crimping includes a tight friction fit between each crimping portion 230 and the strands of wire 226, or in other words, the connection between the crimping portion 230 and the strands of wire 226 is preferably strong enough to prevent the strands of wire 226 from becoming disengaged with the crimping portion 230 when a user attempts to pull the same apart.

In an embodiment, the crimping portion 230 is a single, unitary, integral piece, while in other embodiments, the crimping portion 230 comprises two arms 232, 234, with each arm 232, 234 bent or crimped around, and surrounding a different group of one or more strands of wire 226. In other embodiments, the crimping portion 230 may further include a band (not shown) that is crimped around the protective layer 224 of the wire 206 to further secure the second terminal 208 to the wire 206 at the coupling portion 222.

FIG. 4E illustrates the connection block 200 coupled to the inner housing 106. A pair of fuses 236 are removably coupled to the inner housing 106, with each fuse 236 being positioned in a corresponding one of the pair of fuse channels 154. The fuses 236 each include a first end cap 238 opposite a second end cap 240. A pair of first terminals 104, or terminal blades, are coupled to the inner housing 106, with a connection portion 105 of each terminal 104 electrically coupled to the first end cap 238 of each fuse 236 of the pair of fuses 236. The second end cap 240 of each fuse 236 is electrically coupled to, or in electrical communication with, a corresponding one of the pair of second terminals 208. As described above, each of the pair of second terminals 208 are electrically coupled to a corresponding one of the pair of wires 206, either through crimping as described above, or through other methods of forming an electrical connection between terminals and wires.

Further, FIG. 4E illustrates the bar 158 of the inner housing 106 received by the channel 242 of the connection block 200. As such, the bar 158 assists in limiting the motion of the connection block 200 relative to the inner housing 106, which not only positions the connection block 200 in a proper location to ensure a secure connection between the pair of second terminals 208 and the pair of fuses 236, but also prevents the connection block 200 from causing damage to the components of the inner housing 106 if the electrical plug 100 is dropped to the ground, or is otherwise subjected to an outside force, due to the fact that the ridge 158 limits the motion of the connection block 200 relative to the inner housing 106.

As such, in operation, electrical current from an external source flows through the pair of first terminals 104 to the fuses 236 via the connection portion 105 of each first terminal 104, through each fuse 236 to the pair of second terminals 208 via the coupling between the second end cap 240 of each fuse 236 and each of the second terminals 208 and then to the wires 206 in order to convey power to devices coupled to the wires electrically downstream from the inner housing 106 and connection block 200. Although not illustrated, one of skill in the art will appreciate that the outer housing surrounds the inner housing 106 and the connection block 200 in order to protect users and prevent introduction of contaminants to the electrical system, as described herein. Further, one of skill in the art will appreciate that because the fuses are designed to provide overcurrent protection in the electrical system, the fuses are removably coupled within each of the fuse channels 154, with access to the fuse channels 154 provided through the fourth aperture 132 (not shown) via the fuse cover 118 (not shown) so that a user may replace the fuses 236 as needed.

Figure 5A:
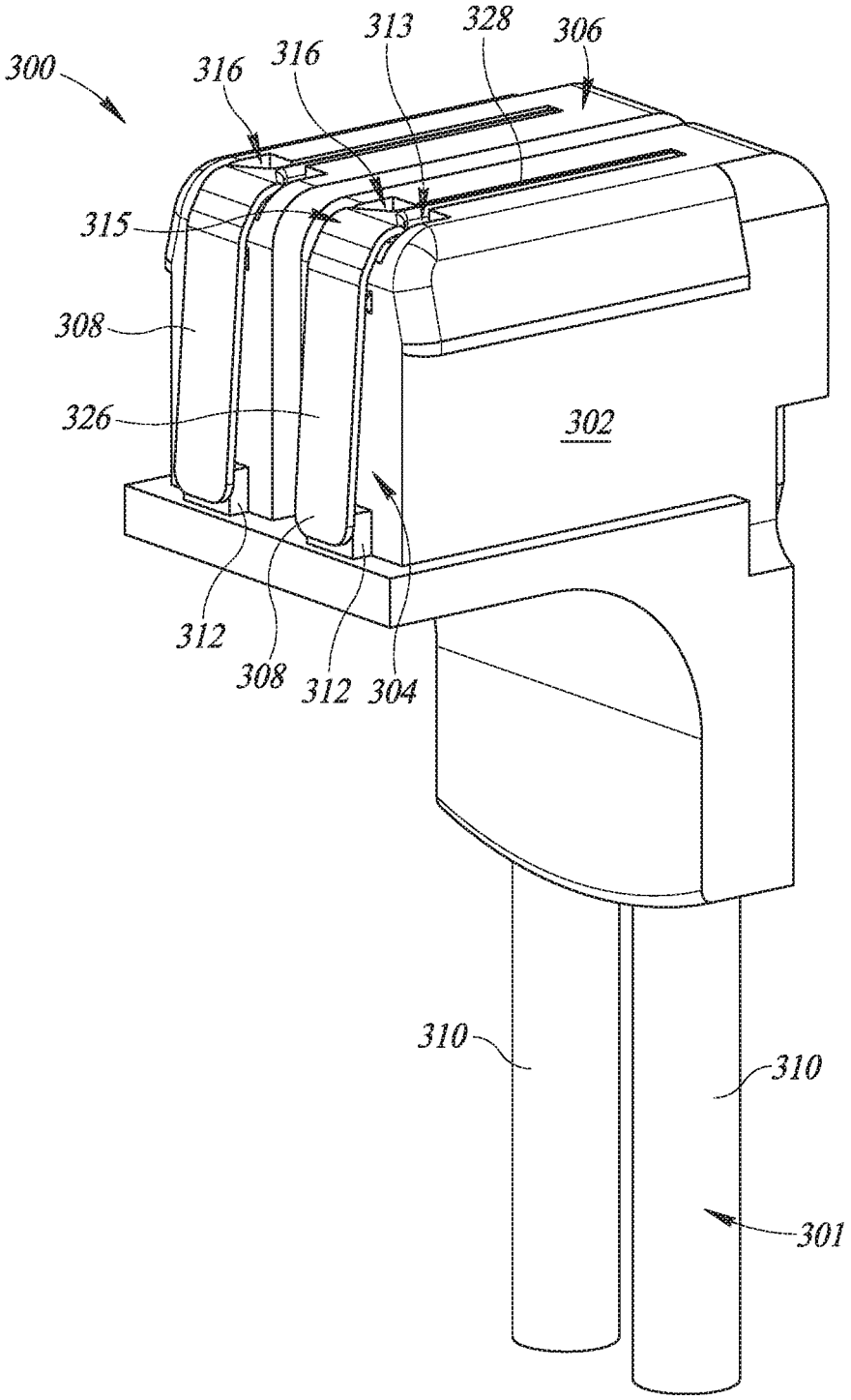
FIG. 5A is a perspective view of an alternative exemplary embodiment of a connection block according to the present disclosure illustrating a housing of the connection block having a first opening in a second surface of the housing.

FIG. 5A illustrates an alternative exemplary embodiment of a connection block 300 having a housing 302 wherein the housing 302 includes a first surface 304 adjacent to a second surface 306. The connection block 300 further includes a pair of second terminals 308 electrically coupled to a corresponding one of a pair of wires 310. As will be explained in more detail below, each of the wires 310 is positioned in a corresponding one of a pair of tunnels 318. Further, each of the wires 310 includes a protective layer 301 covering each of the wires, with strands of wire 305 (FIG. 5E) positioned within, and surrounded by the protective layer 301, similar to the wires discussed in other embodiments disclosed herein. One of skill in the art will appreciate that in certain embodiments, the protective layer 301 is a non-conductive layer comprised of a waterproof insulating material, such as various plastics or polymers.

A pair of protrusions 312 project from the first surface 304 of the housing 302, with each of the pair of second terminals 308 positioned proximate to, or preferably in contact with, a corresponding one of the pair of protrusions 312. In other words, the pair of protrusions 312 are spaced from each such that each protrusion 312 is substantially aligned with a corresponding one of the pair of second terminals 308.

Figure 5B:
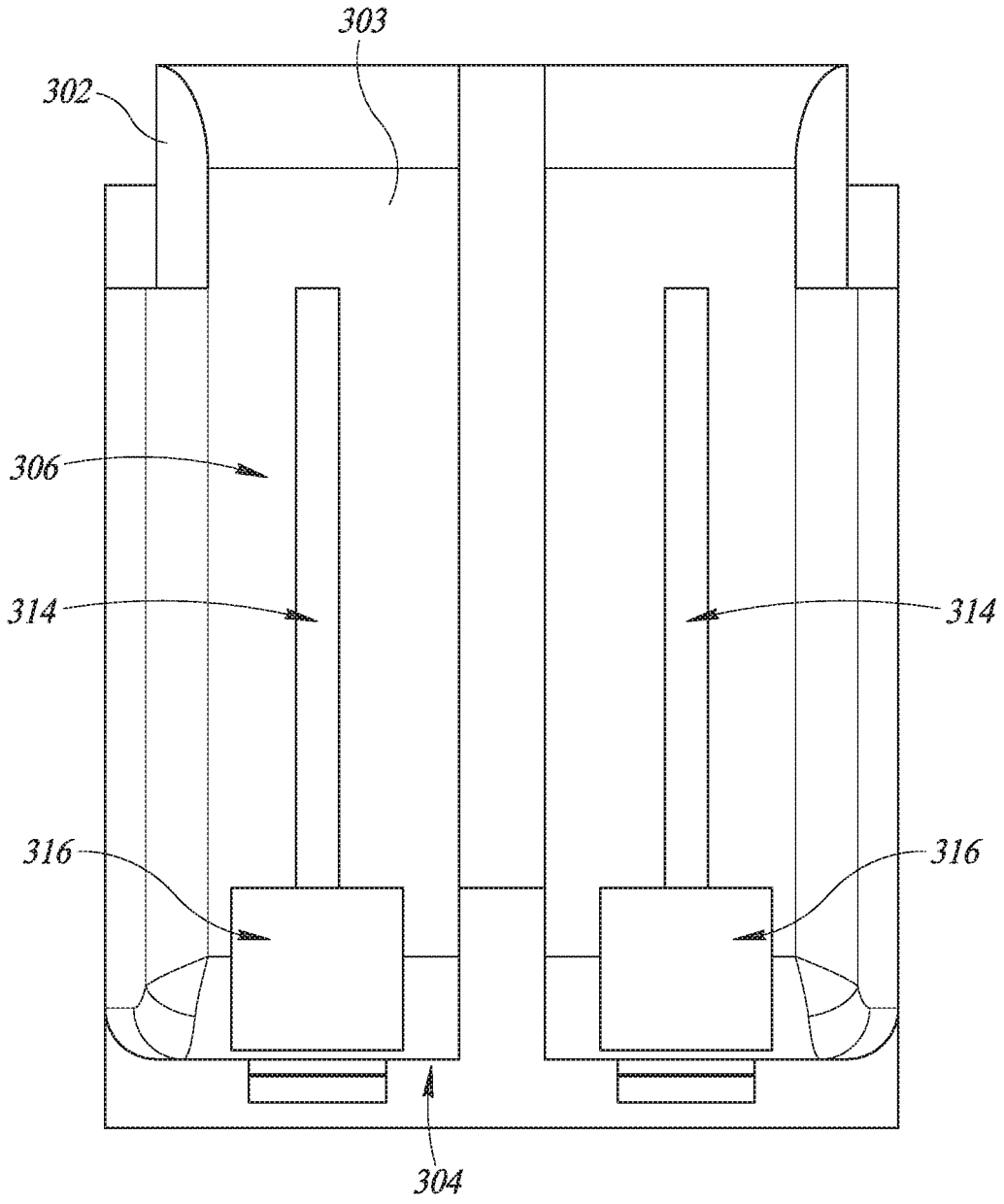
FIG. 5B is a top plan view of the housing of the connection block of FIG. 5A.
Figure 5C:
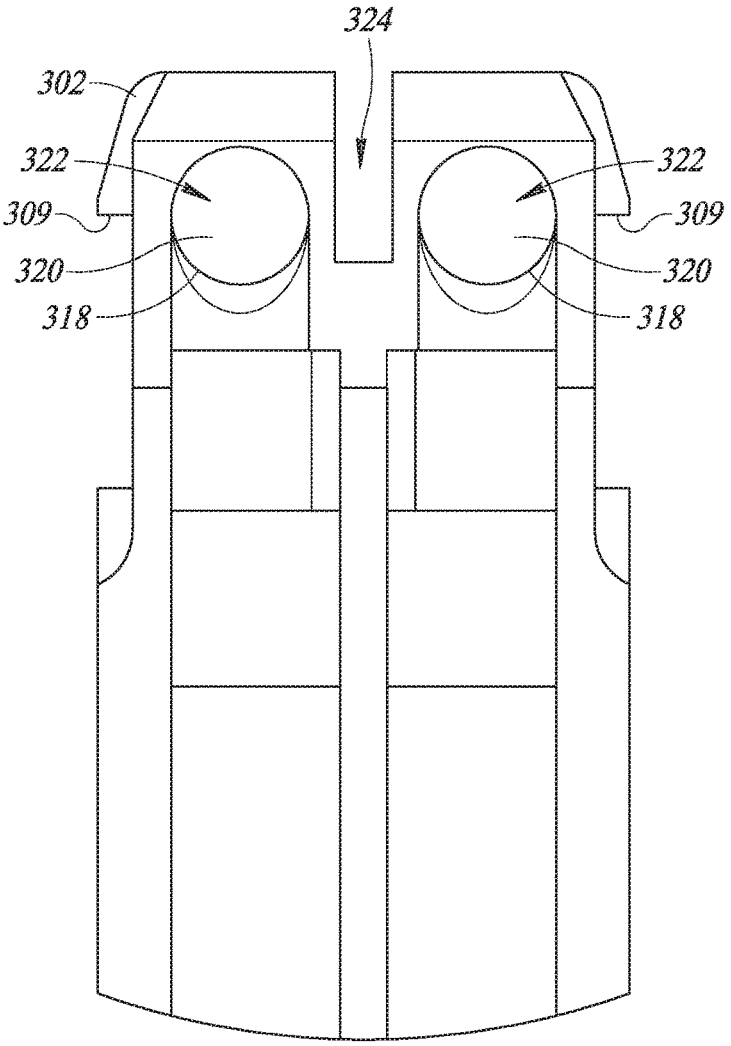
FIG. 5C is a rear elevational view of the housing of FIG. 5B.

FIGS. 5B-5C illustrate the housing 302 of the connection block 300 in additional detail. The housing 302 includes the pair of tunnels 318 having a first opening 314 in the second surface 306 of the housing 302, wherein the second surface 306 is adjacent the first surface 304. Each of the first openings 314 extends through a wall 303 of the housing 302 to connect to a respective one of the tunnels 318. In an embodiment, as illustrated, each of the first openings 314 of each tunnel of the pair of tunnels 318 includes a slot extending along a length of the second surface 306. Each tunnel 318 further includes a second opening 322 and a back wall 320.

The housing 302 can further include a channel 324 having a size and a shape to receive the ridge 158 of the inner housing 106, as described above with reference to FIGS. 4A-4E. To further secure the connection block 300 to the inner housing 106 and outer housing 102, the housing 302 includes a pair of opposing flanges 309, wherein each flange of the pair of opposing flanges 309 physically securely engages a corresponding one of the pair of opposing ridges 152 when the connection block 300 is in an engaged, operational position, such as in FIG. 1A.

In certain other embodiments, the second surface 306 of the housing 302 of the connection block 300 includes a pair of opposing inserts 316, wherein each first opening 314 is connected to, or ends at, a corresponding one of the opposing inserts 316. As shown in FIG. 5A, each of the inserts 316 has a size and a shape to receive a portion 315 of a terminal member 326 and a portion 313 of a connection member of each of the pair of second terminals 308.

Figure 5D:
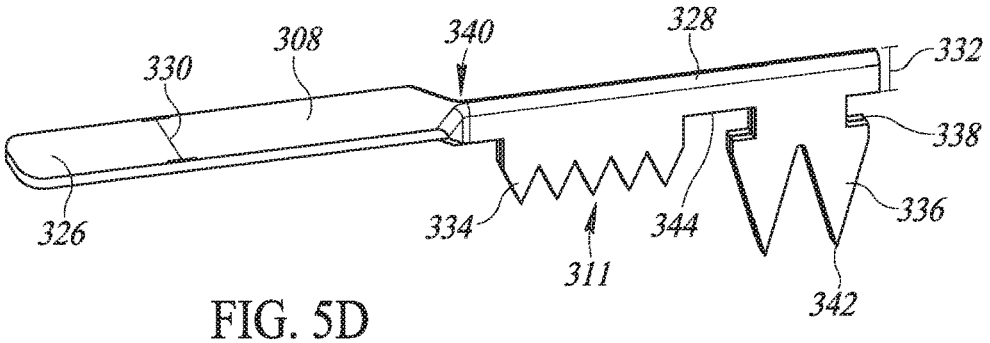
FIG. 5D is a perspective view of a terminal of the connection block of FIG. 5A.

FIG. 5D is an illustration of a representative terminal of the pair of terminals 308. Each terminal 308 includes the terminal member 326 coupled to, and extending from, the connection member 328 via a transition section 340. In the illustrated embodiment, a thickness 330 of the terminal member 326 is greater than a height 332 of the connection member. However, in other embodiments, the thickness 330 is equivalent to the height 332, while in further embodiments, the height 332 is greater than the thickness 330. Further, each of the terminals 308 includes a plurality of first teeth 334 and a plurality of second teeth 336 extending from an outer edge 344 of the connection member 328. In other words, each terminal 308 includes at least one serrated edge 311, wherein the serrated edge 311 includes the plurality of first teeth 334, or the plurality of second teeth 336, or both. In an embodiment, the second plurality of teeth 336 include a flange 338 positioned along the teeth 336 between an outer edge 342 of each tooth of the plurality of second teeth 336 and the outer edge 344 of the connection member 328.

Figure 5E:
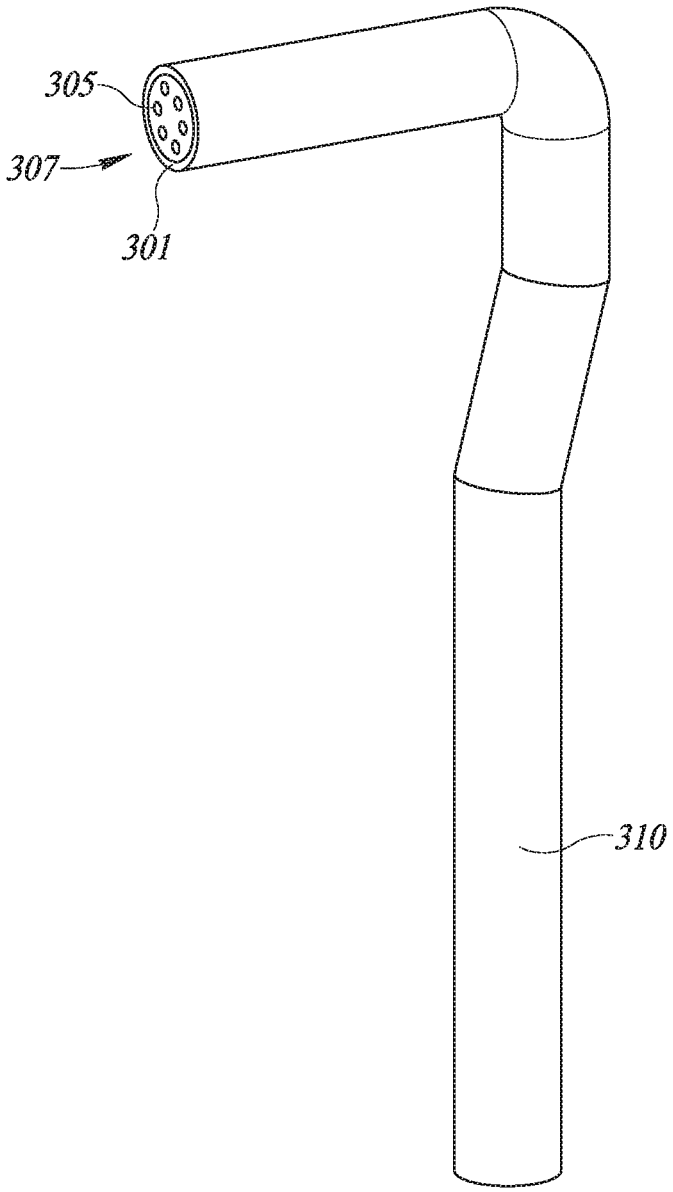
FIG. 5E is a perspective view of a wire of the connection block of FIG. 5A.

FIG. 5E illustrates a representative wire 310 of the connection block 300 (FIG. 5A) with the protective layer 301 removed from an end 307 of the wire 310. However, in light of the below description regarding coupling the wire 310 to the terminals 308, one of skill in the art will appreciate that the end 307 of the wire 310 may be covered by the protective layer 301, and preferably is covered by the protective layer 301, when the connection block 300 is in the operating position within the electrical plug 100. As such, the choice to illustrate the wire 310 with the protective layer 301 removed from the end 307 is simply to clarify the internal features of the wire 310. The wire 310 includes a plurality of strands of wire 305 covered by the protective layer 301. As noted above, the protective layer 301 is preferably a non-conductive layer comprising a waterproof, electrically insulating material.

With reference to FIGS. 5A-5E, when the connection block 300 is assembled, one wire of the pair of wires 310 is inserted into a corresponding tunnel of the pair of tunnels 318 through the second opening 322. Preferably, an end of the wire 310 will be positioned proximate to, or more preferably, in contact with, the back wall 320 of each tunnel 318. Then, a connection member 328 of each terminal of the pair of terminals 308 is inserted through the first opening 314 in the second surface 306 of the housing 302. A force is applied to the connection member 328 in the direction of the wire 310, such that the terminal 308 pierces the protective layer 301 covering each of the wires 310.

In other words, the plurality of first teeth 334 and the plurality of second teeth 336 pierce the protective layer 301, with the flange 338 of the plurality of second teeth 336 securely physically engaging the protective layer 301 covering each of the wires 310. In an embodiment, the serrated edge 311 of the terminal 308 pierces the protective layer 301. As such, the flange 338 prevents the terminals 308 from becoming disengaged with the wires 310 after the piercing. One of skill in the art will understand that the first and second teeth 334, 336, after piercing the protective layer 301, will be in contact with the strands of wire 305 that are covered by the protective layer 301. Because the terminal 308 and the strands of wire 305 are comprised of electrically conductive material, an electrical coupling is formed between each terminal 308 and each wire 310 through the piercing.

Figure 5F:
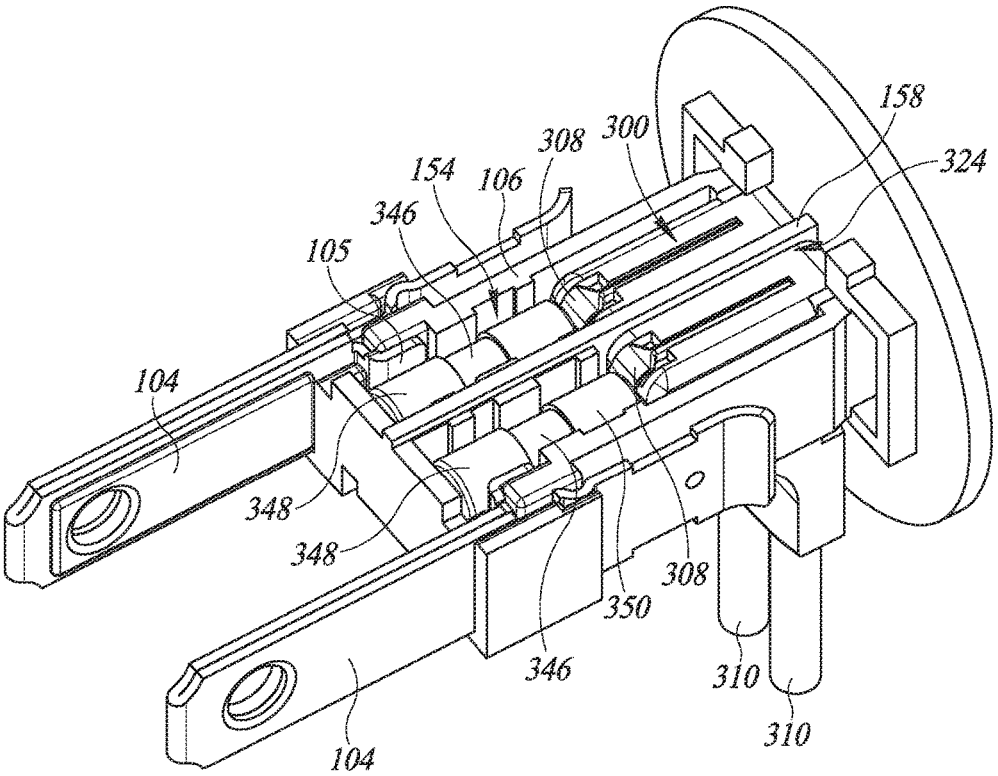
FIG. 5F is perspective view of the connection block of FIG. 5A coupled to an inner housing.

FIG. 5F illustrates the connection block 300 coupled to the inner housing 106. A pair of fuses 346 are removably coupled to the inner housing 106, with each fuse 346 being positioned in a corresponding one of the pair of fuse channels 154. The fuses 346 each include a first end cap 348 opposite a second end cap 350. The pair of first terminals 104, or terminal blades, are coupled to the inner housing 106, with the connection portion 105 of each terminal 104 electrically coupled to the first end cap 348 of each fuse of the pair of fuses 346. The second end cap 350 of each fuse 346 is electrically coupled to, or in electrical communication with, a corresponding one of the pair of second terminals 308.

As described above, each of the pair of second terminals 308 are electrically coupled to a corresponding one of the pair of wires 310, preferably through piercing, although other methods of forming an electrical connection may be used. Further, FIG. 5F illustrates the bar 158 of the inner housing 106 received by the channel 324 of the connection block 300. As such, the bar 158 assists in limiting the motion of the connection block 300 relative to the inner housing 106, as described herein.

As such, in operation, electrical current from an external source flows through the pair of first terminals 104 to the fuses 346 via the connection portion 105 of each first terminal 104 being in contact with the electrically conductive first end cap 348 of each fuse 346. The current travels through each fuse 346 to the pair of second terminals 308 via the coupling between the second end cap 350 of each fuse 346 and each of the second terminals 308 and then to the wires 310 via the electrical coupling between each wire 310 and each terminal 308. As such, the inner housing 106 and connection block 300 convey electrical current from an external source to devices coupled to the wires electrically downstream from the inner housing 106 and connection block 300. Although not illustrated, one of skill in the art will appreciate that the outer housing surrounds the inner housing 106 and the connection block 300 in order to protect users and prevent introduction of contaminants to the electrical system, as described herein. Further, one of skill in the art will appreciate that because the fuses are designed to provide overcurrent protection in the electrical system, the fuses are removably coupled within each of the fuse channels 154, with access to the fuse channels 154 provided through the fourth aperture 132 (not shown) via the fuse cover 118 (not shown) so that a user may replace the fuses 346 as needed.

One of skill in the art will further appreciate that the connection block 120 of FIGS. 1A-1B can be either the connection block 200 or the connection block 300 described above, or a connection block having any combination of features from the connection blocks 200, 300. For example, in an embodiment, a connection block includes one terminal electrically coupled to a wire by piercing and another terminal electrically coupled to another wire by crimping. Further, each connection block 200, 300 can be coupled to a plug including a body comprising the outer housing 102 and the inner housing 106, wherein the body includes an aperture in a wall of the body. In an embodiment, the aperture in the wall of the body is the third aperture 128. A pair of first terminals, or terminal blades 104, are coupled to the body and the pair of fuses 236, 346 are positioned within the body, each of the pair of first terminals 104 electrically coupled to a corresponding one of the pair of fuses 236, 346, as described herein.

In an alternative embodiment, each of the connection blocks 200, 300 can be coupled to a plug including a body, wherein the body is comprised of the outer housing 102 and the inner housing 106 with an aperture extending into the body. In one example, the aperture is the third aperture 128, although the aperture may also be any of the first, second, third, or fourth apertures 126, 130, 128, 132. As described herein, a pair of first terminals 104 are coupled to the body along with a pair of fuses 236, 346, with each of the pair of first terminals 104 coupled to a corresponding one of the pair of fuses 236, 346, as described herein.

In light of the above discussion, one of skill in the art will appreciate that a method for assembling the electrical plug 100 described with reference to the exemplary embodiments disclosed herein includes, with reference to FIGS. 1A-5F, coupling a pair of first terminals 104, such as the pair of terminal blades, and a pair of fuses 236, 346 to the inner housing 106. Then, the fuse cover 118 is inserted into the opposing fuse cover channels 146, which are positioned on an interior surface of the outer housing 102 proximate the fourth aperture 132. The fuse cover 118 is movable between an open position for accessing the fuses 236, 346 through the fourth aperture 132 and a closed position, wherein the fuse cover overlies the fourth aperture 132, thereby preventing access to the fuses 236, 346.

Then, the inner housing 106 is inserted into interior cavity 134 of the outer housing 102 through the second aperture 130 of the second portion 114 of the outer housing 102. The inner housing 106 is pushed through the interior cavity 134 until the base plate 101 is in contact with the support members 142 and the first locking member 144 of the outer housing 102 securely physically engages the second locking member 166 on the inner housing 106. In this configuration, the inner housing 106 extends from the first aperture 126 to the second aperture 130 and is "locked" in an operating position within the outer housing 102, such that the inner housing 106 cannot translate relative to the first or second portions 112, 114 of the outer housing. In other words, the securing surface 168 of the second locking member 166 engages the surface 170 of the first locking member 144, such that the second locking member 166 cannot move past the first locking member 144 without damage to either of the locking members 144, 166 or the housings 102, 106.

The outer housing 102 further includes the third aperture 128 extending through a wall of the outer housing 102 into the internal cavity 134, wherein the ridge 158 of the inner housing 106 defines an upper boundary of the third aperture 128. The connection block 120 is inserted through the third aperture 128. As noted above, the connection block 120 can include the connection block 200 as well as the connection block 300, or other embodiments including any combination of features disclosed herein. As such, in the following discussion, reference will be made to features of the embodiments of the connection blocks 200, 300, even though the same were omitted from the discussion of the connection block 120 simply for clarity and brevity.

The connection block 120 is inserted through the third aperture 128 with the channels 242, 324 aligned with, and engaging the ridge 158 of the inner housing 106. The inner housing 106 further includes a pair of opposing ridges 152 and the connection block 120 includes a pair of opposing flanges 201, 309 that securely physically engage the pair of opposing ridges 152 when the connection block 120 is in the operating position. As such, the pair of opposing ridges 152 and pair of opposing flanges 201, 309 serve to limit the range of motion of the connection block 120 with respect to the housings 102, 106, while also securely coupling, or "locking" the inner housing 106 in place in the operating position. Once the connection block 120 is in place, terminals 208, 308 are securely coupled with fuses 236, 346, such that the electrical plug 100 is in the operating position.

In other words, after inserting the connection block 120 such that the electrical plug 100 is in the operating position, electrical current from an exterior source can flow through the electrical plug 100 along the path described above with reference to FIGS. 4E and 5F.

Figure 6A:
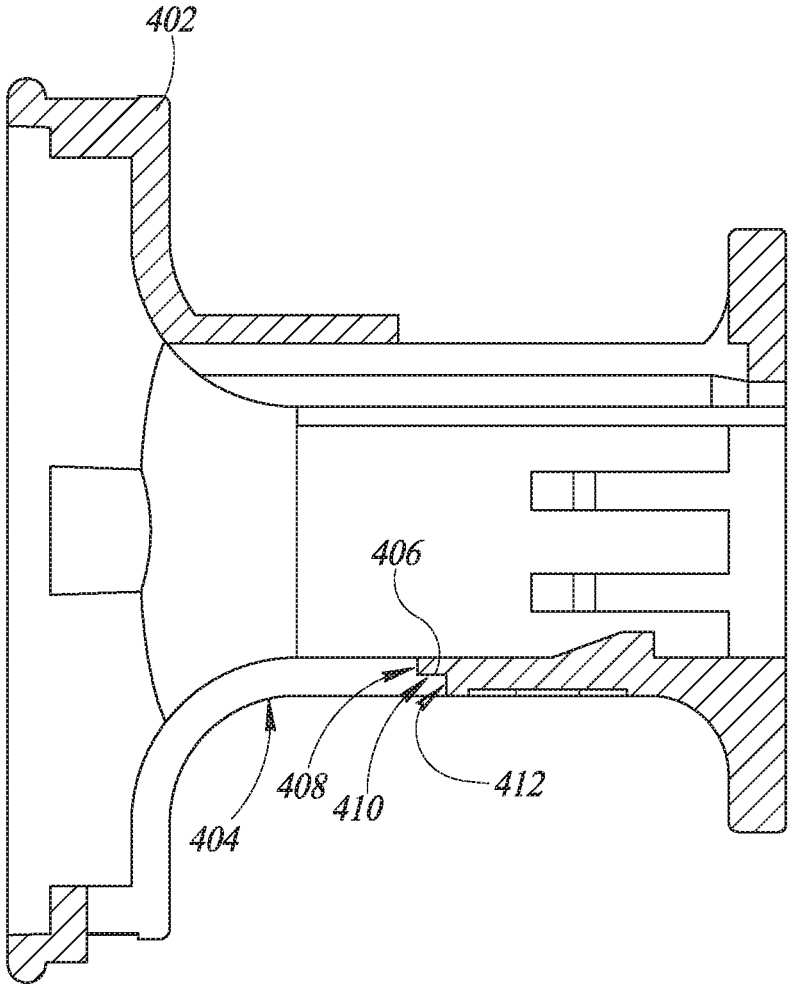
FIG. 6A is a cross-sectional view of an alternative exemplary embodiment of an outer housing for an electrical plug.

FIG. 6A illustrates a cross-sectional view of an alternative exemplary embodiment of an outer housing 402. The outer housing 402 includes an aperture 404, which may be substantially similar to the third aperture 128 in FIG. 2A. However, in this embodiment, a peripheral edge 406 that defines at least one edge of the aperture 404 includes a plurality of surfaces, such as first surface 408, second surface 410 and third surface 412. As shown in FIG. 6A, in an embodiment, the first surface 408 is substantially parallel (e.g., within 3 degrees of parallel) to the third surface 412 and the second surface 410 is substantially perpendicular to the first surface 408 and the third surface 412. However, in other embodiments, each of the surfaces 408, 410, and 412 are at any transverse angle with respect to each other. As will be described in more detail below with reference to FIG. 6F, each of the surfaces 408, 410, and 412 have a size and a shape to securely physically engage surfaces of a connection block (not shown) in order to provide additional protection against water entering the plug through the aperture 404. Further, one of skill in the art will appreciate that the outer housing 402 can include some, all, or none of the features described above with reference to other embodiments of the outer housing described in the present disclosure, such as outer housing 102 (FIG. 2A).

Figure 6B:
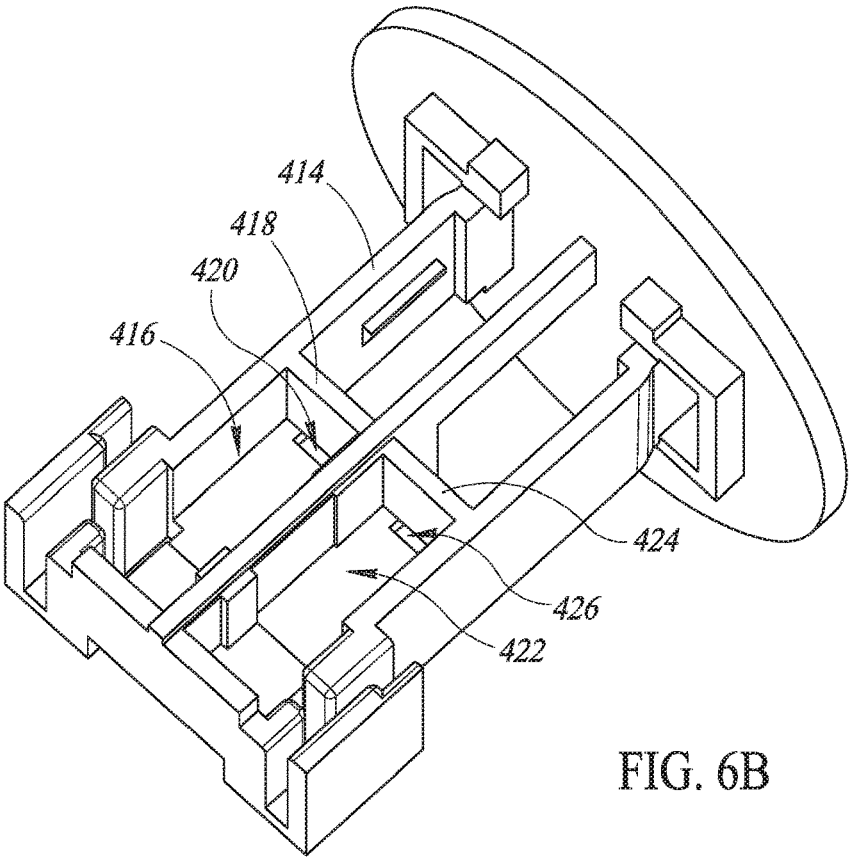
FIG. 6B is a perspective view of an alternative exemplary embodiment of an inner housing for an electrical plug.

FIG. 6B shows a perspective view of an alternative embodiment of an inner housing 414. The inner housing 414 includes a first fuse channel 416 and a second fuse channel 422. The first fuse channel 416 is defined in part by a first wall 418 and the second fuse channel 422 is defined in part by a second wall 424. Proximate a base of the first wall 418 is a first fuse clip aperture 420 and proximate a base of the second wall 424 is a second fuse clip aperture 426. As will be described below with reference to FIGS. 6D-6E, the fuse clip apertures 420, 426 have a size and a shape to each receive and secure a respective fuse clip, such as fuse clip 428 in FIG. 6C.

Figure 6C:
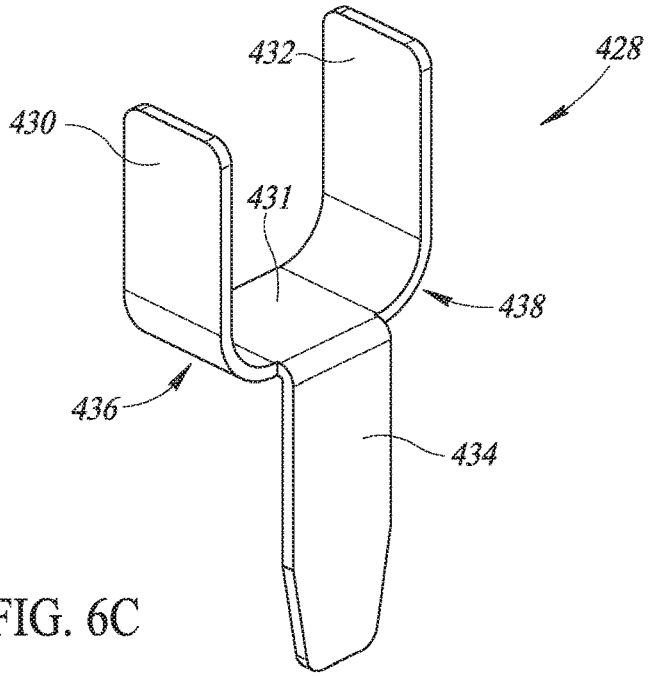
FIG. 6C is a perspective view of an exemplary embodiment of a fuse clip according to the present disclosure.

FIG. 6C illustrates a perspective view of an exemplary embodiment of a fuse clip 428 in an unfolded, or pre-assembly configuration. The fuse clip 428 includes a first arm 430 opposite a second arm 432, with the first arm 430 coupled to the second arm 432 via a base 431. A third arm 434 extends from the base in a direction generally opposite to the first and second arms 430, 432. In this embodiment, the first and second arms 430, 432 are substantially parallel and arranged substantially perpendicular to the base 431. The first arm 430 is connected to the base 431 with a first transition portion 436, which in this case, is continuously curved. Similarly, the second arm 432 is connected to the base 431 by a second transition section 438 with a continuously curved shape. Each of the first and second arms 430, 432 are positioned on the fuse clip 428 such that each arm preferably contacts an opposing surface of a respective fuse channel 416 or 422 (FIG. 6B) of the inner housing 414 (FIG. 6B). In addition, a distance between the arms 430, 432 is preferably of a size and a shape to receive an end cap of a fuse (not shown), such as end caps 348, 350 (FIG. 5F).

One of skill in the art will further appreciate that the fuse clip 428 can be made from a variety of metals or other electrical conductors, either alone, in several plated layers, or in various alloys, including, without limitation, silver, copper, brass, aluminum, nickel, gold, steel, iron, platinum, bronze, or others.

Figure 6D:
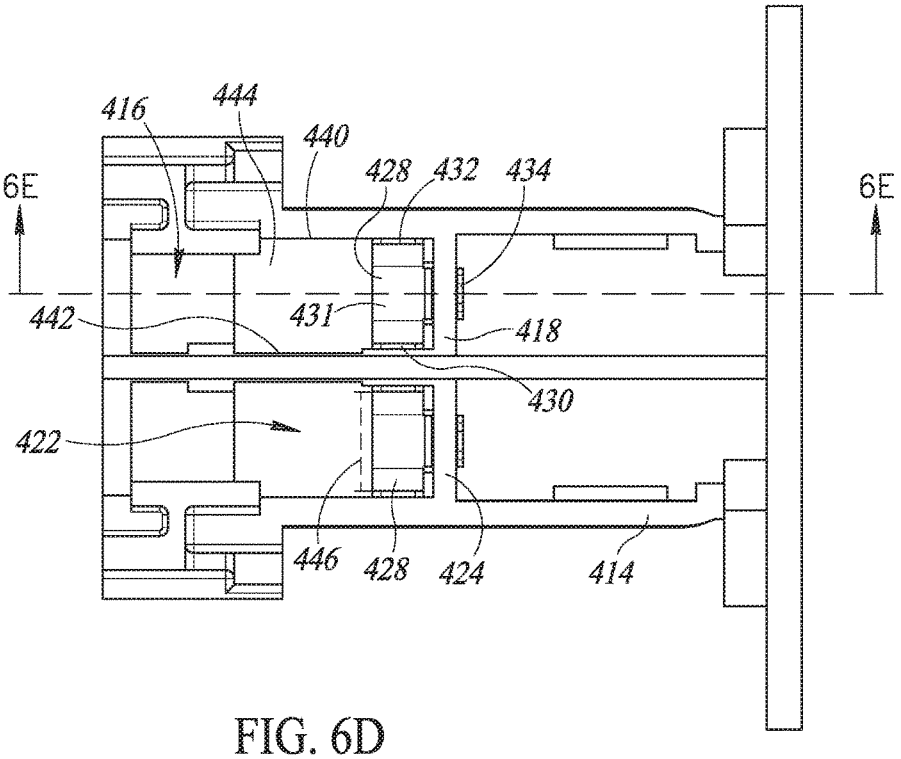
FIG. 6D is a top plan view of the inner housing of FIG. 6B having the fuse clip coupled to the inner housing.

In FIG. 6D, the fuse clips 428 are coupled to the fuse channels 416, 422 of the inner housing 414. During assembly, the third arm 434 of each fuse clip is inserted through a respective fuse clip aperture 420, 426 (FIG. 6B) and bent around the walls 418, 424. In this embodiment, the third arm 434 of each fuse clip 428 preferably contacts a respective one of the walls 418, 424 after the bending, although in other embodiments, there is a gap or space between an outer edge of each of the third arms 434 of each fuse clip 428 and each of the walls 418, 424. Further, when the fuse clips 428 are coupled to the fuse channels 416, 422, the first arm 430 of each fuse clip 428 is preferably in contact with a first sidewall 442 of each fuse channel 416, 422 and the second arm 432 of each fuse clip 428 is preferably in contact with a second sidewall 440 of each fuse channel 416, 422. Further, the base 431 of each fuse clip 428 is preferably in contact with a bottom 444 of each channel 416, 422. Alternatively, there may be a space or gap between each of the first arm 430, the second arm 432, and the base 431 of each fuse clip and the respective sidewalls 440, 442 or bottom 444 of each fuse channel 416, 422.

Accordingly, a method for assembling an electrical plug according to the present disclosure further includes inserting a fuse clip 428 into at least one fuse channel 416, 422 with the inserting including inserting the third arm 434 through the fuse clip aperture 420, 426 and bending the third arm 434 about the wall 418, 424 of the inner housing 414. In an embodiment, the bending includes the third arm 434 contacting the wall 418, 424 at a bottom thereof as well as at least partially along a length of a side of the wall 418, 424.

A distance 446 between the first and second arms 430, 432 of each fuse clip 428 is preferably substantially equivalent to a maximum outer diameter of end caps of a fuse, such as end caps 348, 350 (FIG. 5F). In other words, it is preferable that the first and second arms 430, 432 of each fuse clip 428 are spaced by distance 446 such that the arms 430, 432 engage end caps (such as end caps 348, 350 in FIG. 5F) in a friction fit. Further, it is also possible to vary the distance 446 to accommodate fuse caps of different sizes and shapes, and, or, to vary how tightly the arms 430, 432 of each clip 428 engage the caps.

Figure 6E:
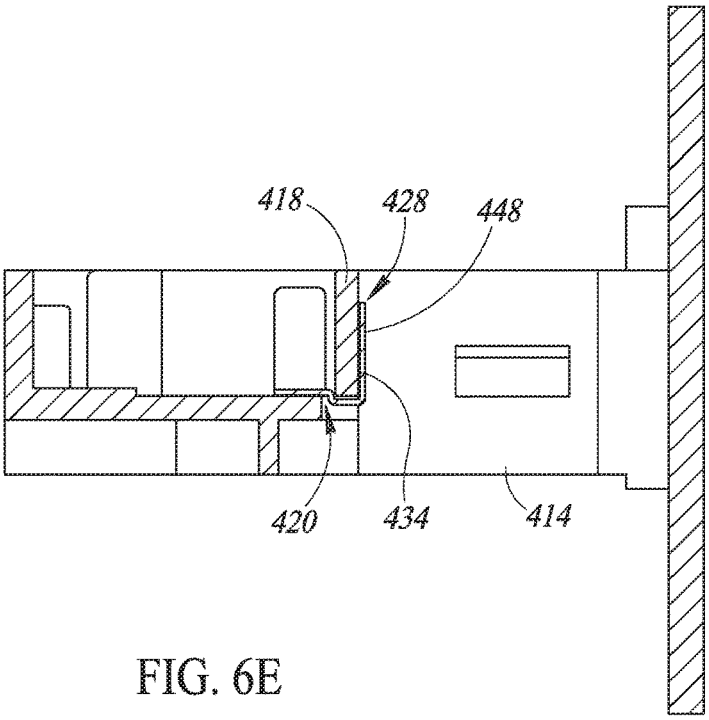
FIG. 6E is a cross-sectional view of the inner housing of FIG. 6D showing the coupling between the fuse clip and the inner housing in additional detail.

FIG. 6E is a cross-sectional view of the inner housing 414 and the fuse clip 428 along line 6E in FIG. 6D. The inner housing 414 includes the first fuse clip aperture 420 and the third arm 434 of the fuse clip 428 inserted through the first fuse clip aperture 420 and bent around the first wall 418. In other words, FIG. 6E depicts the fuse clip 428 coupled to the inner housing 414 in an operational, or assembled configuration. The third arm 434 thus contacts the first wall 418 at a bottom thereof as well as along at least a portion of a length of a side of the first wall 418. The third arm 434 also includes a connection surface 448 that, as explained in more detail below, establishes an connection between one of a pair of terminals of a connection block (such as a respective one of terminals 208 of connection block 200).

Figure 6F:
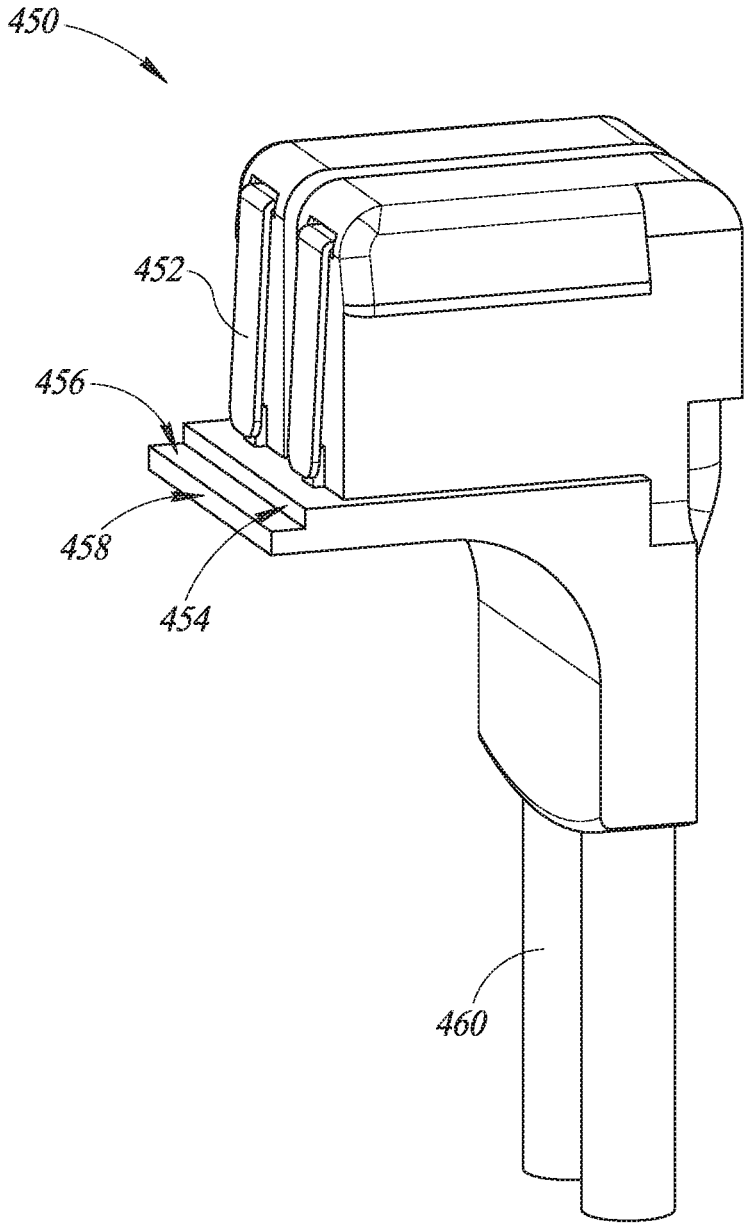
FIG. 6F is a perspective view of an alternative exemplary embodiment of a connection block according to the present disclosure.

FIG. 6F is a perspective view of a connection block 450 having at least one terminal blade 452 and a first contact surface 454, a second contact surface 456 and a third contact surface 458. In the illustrated embodiment, the first contact surface 454 and the third contact surface 458 are substantially parallel, with both surfaces 454 and 458 being substantially perpendicular to the second contact surface 456. However, in other embodiments, these surfaces 454, 456, 458 may be at any number of different orientations with respect to each other. When the connection block 450 is inserted into the outer housing 402 (FIG. 6A) during assembly, the first contact surface 454 preferably contacts the first surface 408 of the outer housing (FIG. 6A). Similarly, the second and third contact surfaces 456, 458 of the connection block 450 preferably contact the second and third surfaces 410, and 412 of the outer housing 402 (FIG. 6A). More preferably, the contact surfaces 454, 456, and 458 of the connection block 450 engage the surfaces 408, 410, and 412 of the outer housing 402 (FIG. 6A) in a friction fit so as to form a substantially watertight and, or, substantially hermetic seal between the outer housing 402 and the connection block. In other embodiments, a gasket or other sealing means (not shown) is used at the interface between such surfaces to further improve the seal between the connection block 450 and the outer housing 402 so as to prevent contaminants (i.e., water, dirt, etc.) from entering the electrical system contained within the outer housing 402.

The connection block 450 further includes the at least one terminal blade 452. When the connection block 450 is assembled into a plug containing the inner housing 414 (FIG. 6B) and the fuse clip (428), the least one terminal blade 452 contacts the third arm 434 at the connection surface 448, such that an electrical connection is established between the fuses (not shown), the fuse clip 428, the connection block 450 and wires 460 extending from the connection block 450, as described herein. In particular, using the fuse clip 428 as described herein provides an easy-to-assemble alternative to a simple fuse-to-terminal connection that allows for a stronger and more reliable electrical connection to be made between connection blocks and housings of embodiments of the present disclosure in certain applications where such a connection is preferable.

One of skill in the art will readily appreciate that although certain details of the embodiments of FIGS. 6A-6F have been omitted for clarity and in the interest of brevity, the embodiments disclosed in FIGS. 6A-6F can incorporate some or all of the features of the embodiments described above with reference to FIGS. 1A-5F.

As will be readily appreciated from the foregoing, the present disclosure achieves an electrical plug that provides a strong connection between the terminals and fuses of the plug, while also providing for an easy-to-assemble process that is suitable for automation. More particularly, because construction of the plugs according to the present disclosure includes merely sliding or pressing different pieces into place, the overall construction process may be easily automated because the construction process does not include any steps that are not suitable for automation, such as the electrical connection between known terminals and the fuses, described above. As such, electrical plugs formed according to the present disclosure are more efficient to manufacture, which reduces consumer cost and labor inefficiencies, but because the plugs provide a stronger connection between the terminals and fuses, the same are also more reliable.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheetare incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A plug, comprising:

an outer housing having an interior cavity extending between a first aperture in a first portion of the outer housing and a second aperture in a second portion of the outer housing, the outer housing including a third aperture in a third portion of the outer housing positioned between the first and second portions, the third aperture extending through the outer housing to the interior cavity;

an inner housing coupleable to the outer housing within at least a portion of the interior cavity, the inner housing extending from the first aperture to the second aperture when the inner housing is in an operating position within the outer housing, the inner housing including a pair of fuse clip apertures proximate a wall;

a pair of fuse clips, each fuse clip of the pair of fuse clips including a first arm, a second arm, and a third arm, wherein, when the plug is assembled, the third arm of each fuse clip is extended through a respective one of the fuse clip apertures and around the wall;

a pair of fuses removably coupled to the inner housing, each fuse coupled to a respective first and second arm of one of the pair of fuse clips;

a pair of terminal blades coupled to the inner housing such that the terminal blades project beyond the second portion of the outer housing when the inner housing is in the operating position, each of the pair of terminal blades electrically coupled to a corresponding one of the pair of fuses; and a connection block insertable into the third aperture and coupleable to the outer housing and the inner housing, the connection block including a pair of wires and a pair of terminals, wherein each wire of the pair of wires is electrically coupled to a corresponding one of the terminals and each terminal of the pair of terminals is electrically coupled to a corresponding third arm of the pair of fuse clips when the connection block is in an engaged position within the outer housing and inner housing, wherein when the connection block is in the engaged position, the inner housing is in the operating position.

2. The plug of claim 1 wherein the electrical coupling between each of the pair of terminals and each of the pair of wires includes crimping each of the terminals to each of the wires.

3. The plug of claim 1 wherein the inner housing further includes a pair of opposing ridges and the connection block includes a pair of opposing flanges, the coupling between the connection block and the inner housing including each of the pair of opposing flanges securely physically engaging a corresponding one of the pair of opposing ridges of the inner housing when the connection block is in the engaged position.

4. The plug of claim 1 wherein the outer housing further includes a fourth aperture extending through the outer housing to the interior cavity and a fuse cover coupled to the outer housing, the fuse cover moveable between an open position and a closed position, in the open position, the pair of fuses exposed through the fourth aperture and in the closed position, the fuse cover overlying the fourth aperture and the pair of fuses.

5. The plug of claim 1 wherein each of the pair of fuses further includes a first end cap opposite a second end cap, the first end cap electrically coupled to a corresponding one of the pair of terminal blades and the second end cap electrically coupled to a corresponding one of the pair of fuse clips.

6. The plug of claim 1 wherein the outer housing further includes a first locking member and the inner housing further includes a second locking member, the first locking member securely physically engaging the second locking member when the inner housing is in the operating position.

7. The plug of claim 1 wherein the connection block further includes a first pair of protrusions and a second pair of protrusions, wherein when the connection block is in the engaged position, each of the pair of terminals contacts a respective one of the first pair of protrusions and a respective one of the second pair of protrusions.

8. The plug of claim 1 wherein the electrical coupling between each of the pair of terminals and each of the pair of wires includes each of the pair of terminals piercing a non-conductive layer covering a corresponding one of each of the pair of wires.

9. The plug of claim 8 wherein each of the pair of terminals includes at least one serrated edge, the at least one serrated edge piercing the non-conductive layer covering each of the pair of wires.

10. The plug of claim 1 wherein the connection block further includes a pair of guides, each guide having an entrance portion with a first area and an exit portion with a second area, the first area being less than the second area, and a groove having a size and a shape to receive a corresponding one of the pair of wires and hold, in combination with the outer housing, the corresponding one of the pair of wires in a bent configuration when the connection block is in the engaged position.

11. The plug of claim 10 wherein the connection block further includes a channel extending into the connection block between the pair of guides.

12. A plug, comprising:

a body having an aperture in a wall of the body, the body including a pair of first terminals coupled to the body and a pair of fuses positioned within the body, each of the pair of first terminals electrically coupled to a corresponding one of the pair of fuses; and a connection block coupled to the body through the aperture in the wall of the body when the connection block is an operating position, the connection block including:

a housing having a first surface and a second surface connected to the first surface by a curved surface;

a pair of guides extending internally through the housing, each guide including an entrance portion extending through the first surface of the housing and an exit portion opposite the entrance portion;

a channel formed in the second surface between each of the pair of guides;

a pair of wires, each of the pair of wires positioned within a corresponding one of the pair of guides;

a pair of second terminals, each of the second terminals extending through the entrance portion of a corresponding one of the pair of guides and electrically coupled to a corresponding one of the pair of wires and a corresponding one of the pair of fuses when the connection block is in the operating position; and a pair of protrusions projecting from the first surface of the housing of the connection block, each of the second terminals being in contact with a corresponding one of the pair of protrusions.

13. The plug of claim 12 further comprising a fuse clip electrically coupled to one of the pair of second terminals and a corresponding one of the pair of fuses.

14. The plug of claim 13 further comprising an inner housing positioned in the body and coupled to the body, the inner housing including a fuse clip aperture, an arm of the fuse clip inserted through the fuse clip aperture.

15. The plug of claim 14 wherein the inner housing further includes a bar proximate the aperture in the wall of the body, the channel of the housing of the connection block having a size and a shape to receive the bar of the inner housing when the connection block is in the operating position.

16. The plug of claim 14 wherein connection block further includes a pair of opposing flanges, each of the pair of opposing flanges mating with a corresponding one of a pair of ridges extending from the inner housing to secure the connection block in the operating position.

17. A plug, comprising:

a body having an aperture extending into the body, the body including a pair of first terminals coupled to the body and a pair of fuses coupled to the body, each of the pair of first terminals electrically coupled to a corresponding one of the pair of fuses; and a connection block extending through the aperture in the body and being coupled to the body when the connection block is an operating position, the connection block including:

a housing having a first surface adjacent a second surface;

a pair of tunnels formed in the housing, each tunnel including a first opening in the second surface of the housing and a second opening;

a pair of wires, each of the pair of wires positioned within a corresponding one of the pair of tunnels;

a pair of second terminals, each of the second terminals positioned proximate the first opening of a corresponding one of the pair of tunnels and electrically coupled to a corresponding one of the pair of wires and a corresponding one of the pair of fuses when the connection block is in the operating position, each of the pair of second terminals including a terminal and a connection member; and a pair of protrusions projecting from the first surface of the housing, each of the second terminals being in contact with a corresponding one of the pair of protrusions, wherein the second surface of the connection block includes a pair of opposing inserts, each of the pair of opposing inserts connected to a corresponding one of the first openings of the pair of tunnels and having a size and a shape to receive a portion of the terminal and a portion of the connection member of each of the pair of second terminals.

18. The plug of claim 17 wherein the first opening of each tunnel of the pair of tunnels includes a slot extending along a length of the second surface.

19. The plug of claim 18 wherein each of the pair of second terminals includes a plurality of first teeth and a plurality of second teeth, the plurality of second teeth including a flange.

20. The plug of claim 19 wherein the electrical coupling between the pair of second terminals and the pair of wires includes piercing a non-conductive layer covering each of the pair of wires with the first and second plurality of teeth of each of the pair of second terminals, the flange of the plurality of second teeth securely physically engaging the non-conductive layer covering each of the pair of wires.

21. A plug, comprising:

an outer housing having an interior cavity and an aperture extending through the outer housing to the interior cavity;

an inner housing coupleable to the outer housing, the inner housing received within at least a portion of the interior cavity when the inner housing is in an operating position, the inner housing including a pair of fuse clip apertures proximate a respective one of a pair of walls;

a pair of fuse clips, each fuse clip including a base and a first arm, a second arm, and a third arm coupled to and extending from the base, wherein, when the plug is assembled, the third arm of each fuse clip is extended through a respective one of the pair of fuse clip apertures and bent around a respective one of the pair of walls of the inner housing;

a pair of fuses removably coupled to the inner housing, each fuse electrically coupled to a respective one of the pair of fuse clips, each fuse of the pair of fuses further including a first end cap opposite a second end cap;

a pair of terminal blades coupled to the inner housing, each of the pair of terminal blades electrically coupled to a corresponding first end cap of each of the pair of fuses; and a connection block insertable into the aperture and coupleable to the outer housing and the inner housing, the connection block including:

a first surface;

a pair of wires;

a pair of terminals, wherein each wire of the pair of wires is electrically coupled to a corresponding one of the pair of terminals and each terminal of the pair of terminals is electrically coupled to the third arm of a corresponding one of the pair of fuse clips when the connection block is in an engaged position within the outer housing and inner housing, wherein when the connection block is in the engaged position, the inner housing is in the operating position; and a pair of guides extending internally through the connection block, each guide having an entrance portion extending through the first surface with a first area and an exit portion with a second area, the first area being less than the second area, and a groove having a size and a shape to receive a corresponding one of the pair of wires and hold, in combination with the outer housing, the corresponding one of the pair of wires in a bent configuration when the connection block is in the engaged position.

22. The plug of claim 21 wherein the inner housing further comprises a pair of opposing ridges and the connection block further comprises a pair of opposing flanges, the coupling between the connection block and the inner housing including each of the pair of opposing flanges securely physically engaging a corresponding one of the pair of opposing ridges of the inner housing when the connection block is in the engaged position.

23. The plug of claim 21 wherein each of the pair of terminal blades is electrically coupled to each of the pair of fuse clips via a corresponding one of the pair of fuses.

24. The plug of claim 21 wherein the connection block further comprises a pair of protrusions extending from the first surface, wherein when the connection block is in the engaged position, each of the pair of terminals contacts a respective one of the pair of protrusions.

25. The plug of claim 21 wherein the inner housing further includes a first fuse channel and a second fuse channel, each of the first and second fuse channels defined at least in part by a corresponding one of the pair of walls of the inner housing, wherein a first one of the pair of fuse clip apertures extends through the first fuse channels and a second one of the pair of fuse clip apertures extends through the second fuse channel.

26. The plug of claim 25 wherein a first one of the pair of fuse clips is received in the first fuse channel and a second one of the pair of fuse clips is received in the second fuse channel.

* * * * *